US007942239B2

(12) United States Patent
Huff et al.

(10) Patent No.: US 7,942,239 B2
(45) Date of Patent: May 17, 2011

(54) EXHAUST MUFFLER

(75) Inventors: Ronald G. Huff, Westlake, OH (US); Keith Skowronski, Broadview Hts., OH (US); Mark Bockwich, Berea, OH (US)

(73) Assignee: TMG Performance Products, LLC, Wadsworth, OH (US)

( * ) Notice: Subject to any disclaimer, the term of this patent is extended or adjusted under 35 U.S.C. 154(b) by 0 days.

(21) Appl. No.: 12/714,570

(22) Filed: Mar. 1, 2010

(65) Prior Publication Data

US 2010/0270103 A1 Oct. 28, 2010

Related U.S. Application Data

(63) Continuation-in-part of application No. 12/217,857, filed on Jul. 9, 2008, now abandoned.

(60) Provisional application No. 60/958,885, filed on Jul. 10, 2007.

(51) Int. Cl.
*F01N 1/02* (2006.01)
*F01N 1/08* (2006.01)
*F01N 1/00* (2006.01)

(52) U.S. Cl. ..... 181/266; 181/250

(58) Field of Classification Search ..... 181/266, 181/250, 251, 273, 276
See application file for complete search history.

(56) References Cited

U.S. PATENT DOCUMENTS 2,014,666 A 9/1935 Peik
2,075,265 A 3/1937 Bourne
2,103,810 A 12/1937 Eduard
2,139,151 A 12/1938 Deremer
2,297,046 A 9/1942 Bourne
3,263,772 A 8/1966 Irwin et al.
3,396,812 A 8/1968 Wilcox et al.
3,434,565 A 3/1969 Fischer (Continued)

FOREIGN PATENT DOCUMENTS

JP 62126215 A 6/1987

OTHER PUBLICATIONS

Handbook of Noise Control, Edited by Cyril M. Harris, Ph.D. Professor of Electrical Engineering and Architecture, Columbia University, McGraw-Hill Book Company, 1957, 4 pages.

(Continued)

*Primary Examiner* — Edgardo San Martin
(74) *Attorney, Agent, or Firm* — Rankin, Hill & Clark LLP

(57) ABSTRACT

A muffler for reducing the sounds of combustion gases exhausted from an internal combustion engine including an elongated fluid passage extending between an inlet and an outlet such that the outlet is in fluid communication with the inlet. Further, the inlet being connectable with the gases exhausted from the engine and the outlet being connectable with the atmosphere. The muffler further including an outer tank surrounding the passage and a tubular connector having a first end in fluid connection with the passage and a second end in fluid connection with the tank such that the connector produces a fluid connection between the passage and the tank. The connectors having a perforated resistance plate to restrict the fluid flow between said passage and said sound chamber thereby reducing the severity of the sound or fluid pulses entering and exiting said sound chamber, perforations in said perforated plate forming an open portion of said plate and said open portion being less than 60 percent.

18 Claims, 17 Drawing Sheets

U.S. PATENT DOCUMENTS

| | | | | |
|---|---|---|---|---|
| 3,648,803 | A | 3/1972 | Heath et al. | |
| 3,655,011 | A | 4/1972 | Willett | |
| 3,680,660 | A | 8/1972 | DuBois | |
| 3,685,616 | A | 8/1972 | Malkiewicz | |
| 4,006,793 | A | 2/1977 | Robinson | |
| 4,415,059 | A | 11/1983 | Hayashi | |
| 4,501,341 | A | 2/1985 | Jones | |
| 4,821,840 | A | 4/1989 | Harwood et al. | |
| 4,874,062 | A | 10/1989 | Yanagida et al. | |
| 4,892,168 | A | 1/1990 | Sasaki et al. | |
| 5,129,793 | A | 7/1992 | Blass et al. | |
| 5,283,398 | A | 2/1994 | Kotera et al. | |
| 5,350,888 | A | 9/1994 | Sager, Jr. et al. | |
| 5,493,080 | A * | 2/1996 | Moss | 181/232 |
| 5,502,283 | A | 3/1996 | Ukai et al. | |
| 5,659,158 | A | 8/1997 | Browning et al. | |
| 5,783,780 | A | 7/1998 | Watanabe et al. | |
| 5,952,625 | A | 9/1999 | Huff | |
| 6,199,658 | B1 | 3/2001 | Huff | |
| 6,334,506 | B1 | 1/2002 | Hamrin et al. | |
| 6,508,331 | B1 | 1/2003 | Stuart | |
| 6,595,319 | B1 | 7/2003 | Huff | |
| 6,684,842 | B1 * | 2/2004 | Hellie et al. | 123/184.57 |
| 7,281,605 | B2 | 10/2007 | Huff et al. | |
| 7,337,609 | B2 * | 3/2008 | Mahnken et al. | 60/297 |
| 7,506,723 | B2 | 3/2009 | Hoerr et al. | |
| 7,690,478 | B2 * | 4/2010 | Kostun et al. | 181/250 |
| 7,798,286 | B2 * | 9/2010 | Skowronski et al. | 181/266 |
| 2004/0245044 | A1 | 12/2004 | Cerrato-Jay et al. | |
| 2005/0161283 | A1 | 7/2005 | Emler | |
| 2006/0027204 | A1 * | 2/2006 | Vogt et al. | 123/184.57 |
| 2007/0102236 | A1 | 5/2007 | Uhlemann et al. | |
| 2009/0014238 | A1 * | 1/2009 | Huff et al. | 181/265 |

OTHER PUBLICATIONS

Noise Reduction, Prepared for a Special Summer Program at the Massachusetts Institute of Technology, Edited by Leo L. Beranek, Lecturer, Massachusetts Institute of Technology, President, Bolt Beranek and Newman Inc., McGraw-Hill Book Company, 1960, 2 pages.

Marks' Standard Handbook for Mechanical Engineers, Revised by a staff of specialists, Eighth Edition, McGraw-Hill Book Company, 1978, 3 pages.

International Search Report dated Oct. 10, 2008 (Appln. No. PCT/U808/08506; filed Jul. 9, 2008).

International Preliminary Report on Patentability, dated Jan. 12, 2010 in connection with PCT/US2008/008506, filed Jul. 9, 2008.

* cited by examiner

| Vehicle | | | | Muffler | | | | | | | | | |
|---|---|---|---|---|---|---|---|---|---|---|---|---|---|
| No. | Size, c.i. | # of Cyl. | Comp. Ratio | Vol. c.i. | Conn. Length, inches | Conn. Inside dia., inches | No. of Conn. | Conn. Area s.i. | Conn. Vol. c.i. | Tailpipe Number | Exhaust Pipe Diameter, inches | Exhaust Pipe Area, sq. inches | Bulk Temp, deg. F. |
| 1 | 180 | 6 | 10.2 | 600 | 4.5 | 2.3 | 1 | 4.15 | 18.70 | 1 | 2.5 | 4.91 | 500 |
| 2 | 180 | 6 | 10.2 | 400 | 4.5 | 2.3 | 1 | 4.15 | 18.70 | 1 | 2.5 | 4.91 | 500 |
| 3 | 204 | 6 | 11.1 | 400 | 4.5 | 2.3 | 1 | 4.15 | 18.70 | 1 | 2.5 | 4.91 | 1100 |
| 4 | 240 | 8 | 12.0 | 519 | 2.3 | 1.5 | 2 | 3.53 | 8.13 | 3 | 2.25 | 3.98 | 250 |
| 5 | 252 | 8 | 11.0 | 430 | 4.5 | 2.3 | 1 | 4.15 | 18.70 | 2 | 2.5 | 4.91 | 450 |
| 6 | 318 | 8 | 10.0 | 500 | 4.5 | 2.3 | 1 | 4.15 | 18.70 | 2 | 2.5 | 4.91 | 500 |
| 7 | 402 | 6 | 17.3 | 1253 | 0.3 | 1.5 | 2 | 3.53 | 1.06 | 2 | 4 | 12.57 | 650 |

FIG. 29

| Muffler | Exhaust Pipe Diameter, inches | No. of Conn. | Conn. Length, inches | Conn. Inside dia., inches | Aperture Porosity, % open | Tank Volume, c.i. |
|---|---|---|---|---|---|---|
| 8 | 2.5 | 1 | 3.6 | 1.5 | 33.6 | 255 |
| 9 | 2.5 | 4 | 0.65 | 1 | 30.3 | 427 |
| 10 | 3 | 4 | 0.88 | 1.5 | 30.3 | 532 |
| 11 | 3 | 4 | 1 | 1.14 | 30.3 | 919 |
| 12 | 4 | 2 | 0.49 | 1.31 | 30.3 | 529 |
| 13 | 2.5 | 2 | 0.45 | 1 | 30.3 | 418 |
| 14 | 2.5 | 1 | 1.64 | 0.67 | 30.3 | 584 |
| 15 | 2.5 | 1 | 1.3 | 0.72 | 30.3 | 399 |
| 16 | 4 | 4 | 0.75 | 2.64 | 33 | 1492 |
| 17 | 4 | 4 | 0.75 | 2.64 | 33 | 1625 |

EXHAUST MUFFLER

This invention relates generally to mufflers for exhaust systems of the sound modifying type used with internal combustion engines to attenuate engine noise and more particularly to mufflers conventionally referred to as side branch and/or tank muffler systems. This application claims priority in Provisional Patent Application Ser. No. 60/958,885 that was filed on Jul. 10, 2007 which is incorporated by reference herein and is a Continuation in Part application of U.S. non-provisional patent application Ser. No. 12/217,857 filed on Jul. 9, 2008 now abandoned which is also incorporated by reference herein.

The invention is particularly applicable to and will be described with specific reference to a side branch and/or tank style muffler for use in both cars and trucks. Further, many of these muffler designs are well suited for high-performance vehicles including high-performance cars and trucks. However, as will be appreciated by those skilled in the art that the inventive concepts disclosed herein may be utilized for any number of muffler applications and in combination with or as part of other muffler systems or concepts for attenuating a specific or a specific range of sound waves.

INCORPORATION BY REFERENCE

The following patents are incorporated by reference as indicative of the muffler art so that details known to those skilled in the art need not be repeated herein:

A) U.S. Pat. No. 5,659,158 to Browning et al., entitled "Sound Attenuating Device and Insert", issued Aug. 19, 1997;

B) U.S. Pat. No. 5,502,283 to Ukai et al., entitled "Muffler", issued Mar. 26, 1996;

C) U.S. Pat. No. 5,350,888 to Sager, Jr. et al., entitled "Broad Band Low Frequency Passive Muffler", issued Sep. 27, 1994;

D) U.S. Pat. No. 5,129,793 to Blass et al., entitled "Suction Muffler", issued Jul. 14, 1992; and, E) U.S. Pat. No. 4,006,793 to Robinson, entitled "Engine Muffler Apparatus Providing Acoustic Silencer" issued Feb. 8, 1977.

F) U.S. Pat. No. 6,595,319 to Huff, entitled "Muffler" issued Jul. 22, 2003.

G) U.S. Pat. No. 6,199,658 to Huff, entitled "Multi-Fold side branch muffler" issued Mar. 13, 2001.

H) U.S. Pat. No. 5,952,625 to Huff, entitled "Multi-Fold side branch muffler" issued Sep. 14, 1999.

BACKGROUND OF THE INVENTION

Engine noise in an internal combustion engine typically is generated by the sudden expansion of combustion chamber exhaust gases. As the combustion gases are exhausted from each cylinder of the engine, a sound wave front travels at rapid sonic velocities through the exhaust system. This wave front is the boundary between the high pressure exhaust pulse and ambient pressure. When the sound wave front exits the exhaust system, it continues to pass through the air until three dimensional diffusion causes it to eventually dissipate. As the wave front passes an object, an overpressure is created at the surface of the object, and it is this overpressure that is a direct cause of audible and objectionable noise.

Since the inception of the internal combustion engine, efforts have been underway to reduce or muffle the noise caused by the engine. Obviously, considerable noise attenuation or reduction can be achieved in a muffler having dimensions that are large enough to permit three dimensional dissipation of the sound waves within the muffler housing. However, from a practical standpoint, design criteria often dictate the size of the muffler which must be kept as small as possible. Further means of reducing engine noise include the use of packing and complex baffle systems. However, these approaches are often accompanied by a substantial increase in the back pressure or resistance of the muffler to the free discharge of the combustion gasses. The increase in backpressure can result in a decrease in the output horsepower of the engine with a resulting loss of efficiency in fuel economy.

Mufflers are classified in various manners within the art. From a structural consideration, mufflers have been classified as being either of two basic types or configurations:

i) a compartmentalized type which comprises several compartments sealed except for the inlets and outlets, the compartments usually being sealed, noise entrapment chambers; or, ii) a type commonly known as a straight through muffler which usually comprises a duct having a series of perforations within a sealed housing.

In accordance with this classification, this invention is particularly adaptable to mufflers of the straight through type although, it could have application to compartmentalized type mufflers.

From a functional view, mufflers may be classified as dissipative or reactive. Dissipative mufflers are typically composed of ducts or chambers filled with acoustic absorbing materials such as fiber glass, steel wool or even porous ceramics. Such materials absorb acoustic energy and transform it into thermal energy. Reactive mufflers, on the other hand, are composed of a number of inner connected chambers of various sizes and shapes in which sound waves are reflected to dampen or attenuate waves of a set frequency, typically resonance frequency. This invention relates more to a reactive type muffler.

There are two types of reaction mufflers, a side branch type muffler and a resonator type muffler. A resonator type muffler uses various volumes of different shapes or sizes, i.e., resonance chambers, interconnected with pipes and can dampen not only resonance frequency but also sound waves having frequencies near the resonance frequency. The drawback to resonator mufflers is the large volume required to dampen low frequency sound waves.

The side branch muffler is the type of muffler that has a straight through pipe and an offset or a side branching off the straight through pipe. The side branch is closed at its end and may be bent or shaped with baffles as shown in some of the patents incorporated by reference herein. When the sound wave reaches the closed end of the side branch, it reflects back towards the open end damping waves at the same frequency and out of phase with the reflected wave. The side branch muffler possesses an advantage over the resonator type muffler in that a large volume is not required to dampen any sound wave of a given frequency. However, low frequency sound waves which produce the most objectionable noise require long, side branch lengths which make it difficult to fit within the confines of certain automotive applications.

The tank style muffler utilizes a large volume to help cancel the sound wave in similar fashion as when the sound wave exits out the tail pipe into the atmosphere. This invention relates more to tank style mufflers, side branch mufflers and combinations thereof.

Apart from the functional and structural discussion above, sports cars and high performance vehicles have additional requirements. It has long been known that the exhaust systems of such vehicles must be tuned to emit certain sounds from the automobile which appeal to the purchaser of such vehicles while satisfying noise regulations. Such applications require attenuation of specific waves having set frequencies to produce the desired sound. More particularly, high performance mufflers of the type under discussion are tuned to the specific type of engine to which the muffler will be applied to. Specifically, the valving or breathing characteristics of the engine are matched to the muffler over the operating range of the engine to produce the desired tone. Recent engineering advances in the structural rigidity of the body or chassis of the vehicle in which the engine is mounted have enhanced the sound of the engine within the cabin of the vehicle. Specifically, a muffler could be tuned to a desired sound with the engine on a test stand, but produce objectionable resonance in the cabin.

The side branch type muffler, in theory, has the ability to resolve this problem. However, the approach followed was random and haphazard and simply involved reconstructing entirely different side branch designs until one resulted in the removal of the objectionable noise. Unfortunately, the length of the side branch typically exceeded the space limitations for the muffler design.

The Huff patents above (U.S. Pat. Nos. 6,595,319; 6,199,658; and 5,952,625) overcame many of these problems with a side branch type muffler which can be readily tuned to produce any desired sound in a compact design avoiding the space limitations afflicting conventional side type mufflers. In this respect, the Huff patents show a muffler with an inner cylindrical casing axially extending from the inlet through the outlet and defining an open ended inner chamber contained therein through which the exhaust gases pass. An outer concentric casing with axial end sections is spaced radially outward from the inner casing and defines therebetween a closed end outer chamber. A slotted opening arrangement at a set axial position provides fluid communication between the inner and outer chamber. A sound attenuating arrangement within the outer chamber includes a plurality of intermediate, cylindrical casings which axially extend substantially the length of the outer chamber and are radially spaced to overlie one another so that each pair of radially adjacent casings forms an annular, axially extending sound attenuation passage. Each sound passage has an entrance in fluid communication with a pressure wave at one end thereof and a sound reflection wall at its opposite end to establish a second path therebetween. Certain select sound passages have an entrance in fluid communication with the slotted opening while other sound passages have an entrance in fluid communication with an adjacent sound passage whereby a plurality of sound passages having various sound path lengths is produced for reflecting and attenuating a plurality of sound waves at set frequencies, particularly sound waves of low frequency. It was found that this muffler configuration is effective in eliminating objectionable sounds.

Further, the Huff muffler can be modified to include at least one annular stop plate extending within a selected sound passage between radially adjacent intermediate casings forming the selected sound passage. The stop plate is positioned at a set axial distance within the selected sound passage correlated to the axial distance a sound wave travels from a passage entrance to the stop plate whereby any sound wave of any specific frequency may be attenuated by positioning the stop plate at a set axial distance in a sound passage thus permitting the muffler to be tuned to any desired sound.

However, while the Huff muffler is effective, it is limited in its application due to the size of the radially spaced sound passages. In this respect, the radially spaced sound passage produces a muffler that is cylindrical with a side dimension equal to the height dimension. Many applications have different height and width requirement wherein the cylindrical configuration exceeds one of these dimensional limitations. Further, additional sound chambers, to attenuate multiple frequencies, increase the length of the muffler wherein it can be too long for certain vehicles. The Huff mufflers can also be costly to manufacture in that they require successively decreasing radial height for each successively larger diameter sound passages of the outer passages to avoid pressure undulations and accompanying sound wave variations as the waves travel in a sound path from one sound passage to another radially spaced sound passage.

Further, trucks also have their own special requirements in view of their larger engines and the use of diesel engines utilized for their large amounts of torque, fuel efficiency and longevity. While trucks typically do not have the same size issues as sports cars, many of the other characteristics are similar in view of the more powerful engines in these vehicles. Further, many of the engines used in trucks are the same or similar engines used in performance cars.

SUMMARY OF THE INVENTION

In accordance with the present invention, provided is a muffler which can be readily tuned to produce a desired sound in a subcompact and lightweight design allowing use in virtually all types of vehicles. More particularly, provided is a muffler that maximizes performance characteristics in a lightweight and efficient design even though it is for use with large and powerful engines.

More particularly, provided is a muffler for reducing sounds from an exhaust flow traveling through an exhaust pipe of a vehicle wherein the flow is caused by gases exhausted from one or more exhaust valves of an internal combustion engine in sound or fluid pulses relating to the flow from these one or more valves. The muffler includes an elongated fluid passage extending between a muffler inlet and a muffler outlet and the muffler inlet and muffler outlet being connectable with the exhaust pipe of the vehicle whereby the elongated fluid passage forms a portion of the exhaust pipe and has a cross-sectional area similar to the adjacent exhaust pipe. As a result, the exhaust flow travels through the elongated fluid passage without restriction. The muffler further includes a closed sound chamber surrounding the passage and this sound chamber can be formed by a side wall extending about the fluid passage and extending between two end plates. At least one tubular connector in the fluid passage extends between the end plates and provide fluid communication between the passage and the closed sound chamber. The connector has a tubular body with a first end joined to an opening in the passage and a second end opening into the closed sound chamber.

However, it has been found that while this arrangement can be effective in reducing exhaust sound, this arrangement can produce unwanted oscillation in certain muffler components wherein another aspect of the invention of this application further includes a tubular connector with a perforated resistance plate to restrict the fluid flow between the passage and the sound chamber thereby reducing the severity of the sound or fluid pulses entering and exiting the sound chamber. This resistant plate includes perforations forming an open portion of the plate, the open portion is less than 60 percent. More particularly, it has been found that unrestricted flow between the muffler pipe and the tank or sound chamber can be undesirable. This is especially true when trying to minimize the weight of the muffler. Lightening the muffler can include the use of lightweight materials when and where they can be used. One way to reduce weight is by reducing material thicknesses. Thus, thinner materials have been investigated which can drastically reduce the weight of a muffler. However, these thinner materials must still function similar to the thicker materials that they replace or they cannot be used. It was found that the material thickness of the outer walls of the muffler could only be reduced so much before they began to vibrate as the fluid pulses entered and exited the sound chamber. This vibration causes an unwanted sound that is almost as bad as the objectionable sound produced by the exhaust. While internal ribbing or other structural reinforcing members were considered, this adds weight and adds to the cost of the muffler. Thus, it was first believed that the weight reduction would not be as significant as first desired. But, the use of a restriction plate has been found to eliminate or reduce this vibration.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein:

FIG. 29 is a chart relating to a study of certain vehicle applications and certain aspects of the invention of this application;

DETAILED DESCRIPTION OF THE INVENTION

Figure 1:
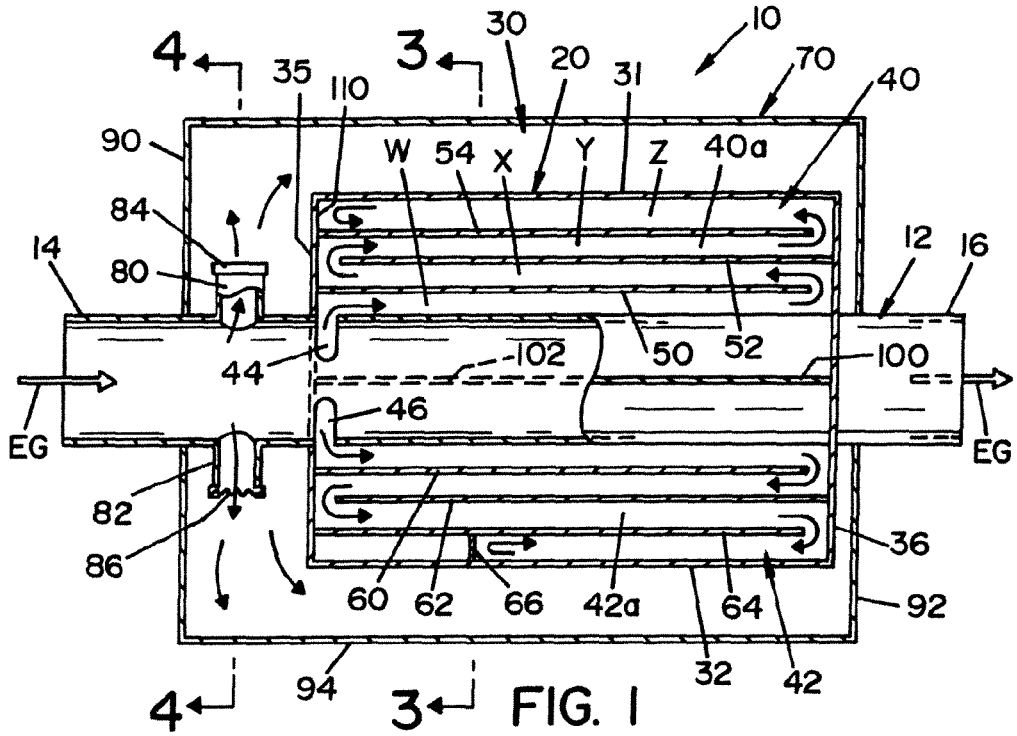
FIG. 1 is a top sectional view of one embodiment of the present invention which includes both dual inner sound chambers and an outer sound chamber.
Figure 2:
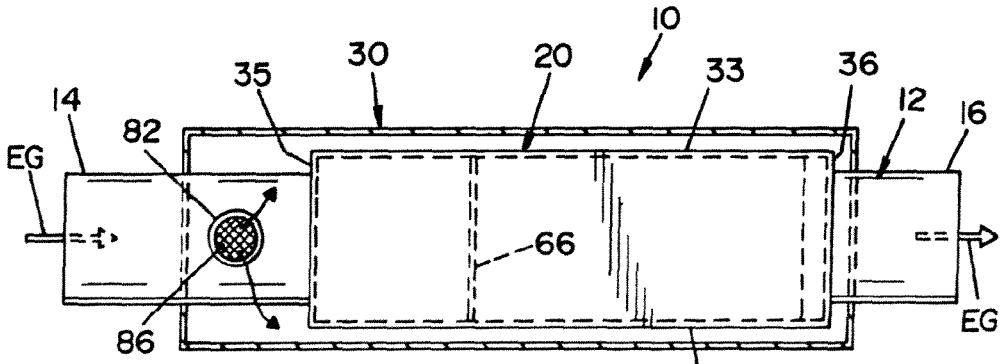
FIG. 2 is a side view, partially in section, of the muffler shown in FIG. 1.
Figure 3:
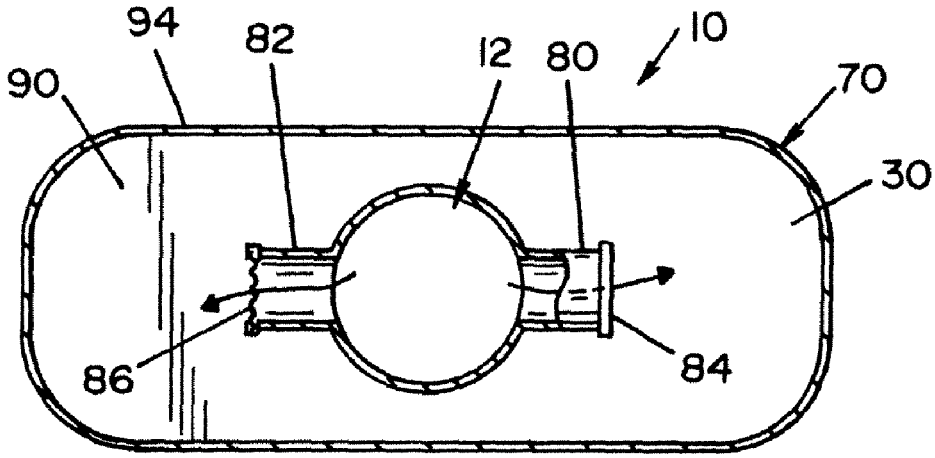
FIG. 3 is a sectional view taken along lines 3-3 in FIG. 1.

Referring now to the drawings wherein the showings are for the purpose of illustrating preferred and alternative embodiments of the invention only and not for the purpose of limiting same, there is shown in FIGS. 1-4 a muffler 10 illustrating at least one embodiment of the present invention.

Muffler 10 has an inner, axially extending through pipe or passage 12 which can be tubular, as is shown, and includes an inlet 14 and an outlet 16 wherein the exhaust of an internal combustion engine flows through muffler 10 from inlet 14 to outlet 16. Muffler 10 further includes an inner sound vessel 20 and an outer sound chamber 30. The arrows in FIG. 1, and in other Figures in this specification, generally show the flow of exhaust gases but, are illustrated in nature only in that they are intended to generally show the gas flow and/or sound or fluid pulse flow through the sound chambers at a given time and they do not show all flow patterns within muffler 10. It should be noted that throughout this application the wording tubular is used and this word is not to be limited to an elongated body with a circular cross-sectional configuration. Conversely, the wording tubular can be any hollow body and this hollow body can have a wide range of cross-sectional configurations.

Turning to inner vessel 20, included is a box structure having side walls 31 and 32 extending parallel to one another; a top wall 33 and a bottom wall 34 extending parallel to one another wherein walls 31-34 extend between end plates 35 and 36. Vessel 20, in this embodiment, includes a first inner sound chamber 40 having a sound passage 40*a* and a second inner sound chamber 42 having a sound passage 42*a*. The exhaust gases, EG, that flow into muffler 10, are directed to the first chamber by a sound attenuation opening, opening as slot 44. Sound chamber 40 includes dividers or partitions 50, 52 and 54 to extend the length of the sound passage 40*a* which will be discussed in greater detail below. As can be appreciated, more than or less than three partitions can be utilized without detracting from the invention of this application. As will be discussed in greater detail below, the number of partitions is a function of the length of the inner vessel along with the wavelength and/or frequency of the sound wave to be attenuated. In this particular embodiment, sound chamber 42 includes a similar configuration as sound chamber 40 wherein it includes three partitions or dividers 60, 62 and 64. However, chamber 42 further includes a stop plate 66 such that passage 42*a* is shorter than passage 40*a* to attenuate a different sound wave. In view of the two different inner lengths, a wider range of frequencies can be attenuated by inner vessel 20.

With respect to outer sound chamber 30, this chamber can be formed by an outer housing 70 and the outer walls of inner vessel 20. As with all embodiments of this application which include functional outer housings, a wide range of sound reducing arrangements can be utilized in outer sound chamber 30 formed by the housing. These can include methods known in the art such as compartmentalized systems and dissipation systems. For example, outer sound chamber 30 could include acoustic absorbing material packed in housing 70 where the material can be fiberglass material configured to further deaden sound and/or reduce a particular frequency of sound produced by the internal combustion engine.

Chamber 30 can include a first inlet tube 80 and a second inlet tube 82. While two inlet tubes are shown, more or less inlet tubes can be utilized in connection with the outer sound chamber based on the technology used in the chamber and the particular frequency to be deadened. Further, while cylindrical inlet tubes are shown, other tube configurations can be utilized without detracting from the invention of this application. Tubes 80, 82 can further include mesh outlets 84 and 86, respectively. The combination of the tube diameter, length and the hole size of the mesh outlet can be utilized to control the flow of exhaust gas EG into the outer sound chamber. In addition, inlet tubes 80 and 82 are shown near inlet 14 of the muffler, these tubes can be positioned anywhere along through pipe 12. For example, tubes 80 and 82 can be positioned near outlet 16 downstream of inner vessel 20.

Housing 70 can be constructed as is known in the art including being constructed with end plates 90, 92 and a side wall 94 extending between the end plates. Housing 70 also generally fixes the position of the inlet 14 and the outlet 16 of through pipe 12 and can function as a support for the brackets and the like, if needed, for securing muffler 10 within the vehicle's exhaust system. However, it is also possible to eliminate outer housing 70 and utilize the outer box structure of inner vessel 20 to mount muffler 10 to the exhaust system of the vehicle. Further, the materials utilized to produce both the inner and outer chamber can be those known in the art of sufficient strength to support the muffler within the system and produce a muffler of sufficient integrity to have a long service life. These materials can include, but are not limited to, stainless steels that are known in the art to produce a long service life.

As is discussed above, the fluid connection between through pipes 12 and chamber 40 is via slot 44. While it is shown as being a single slot, multiple slots could be utilized to provide the fluid connection between the through pipe and the chamber. The area of opening or slot 44 should be similar to the cross-sectional area of flow path 40*a* within sound chamber 40 such that the wave that travels through chamber 40 is not dispersed and is maintained as a unified wave. However, the slot producing the fluid connection can be a different area but should be at least 70% of the through pipe flow area within the flow path of the respective chamber to maximize the sound attenuation. Similarly, opening or slot 46 should also be configured to have a similar area as cross-sectional flow path 42*a* found in chamber 42. Chambers 40 and 42 can be separate chambers that are separated by ribs 100 and 102 that are affixed to through pipe 12 and the housing of inner vessel 20. As will be discussed in relation to embodiments below, the system can include a cross-over arrangement wherein there is at least one gap in at least one of these ribs. As is discussed above, chamber 42 includes end plate 66 which produces a different length in the sound passage found in chamber 42 thereby providing sound attenuation for a different frequency wave form.

Figure 4:
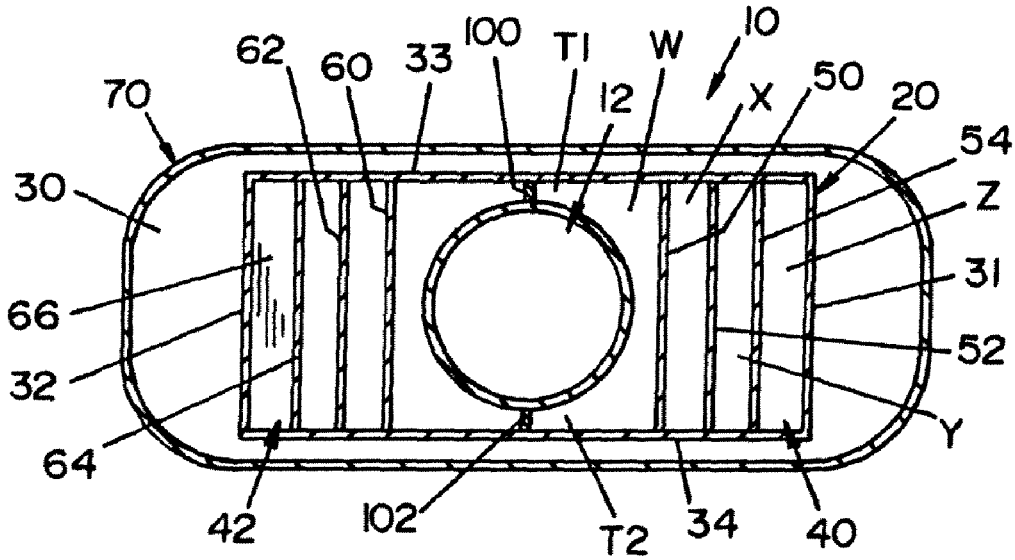
FIG. 4 is a sectional view taken along lines 4-4 in FIG. 1.

With special reference to FIG. 4, the acoustic wave flow path areas of this embodiment and other embodiments in this application influence the sound attenuation of the particular sound chamber. In this respect, the cross-sectional area of the sound wave flow path will determine, at least in part, the amount of acoustic power that will flow through a given wave path. As can be appreciated, the larger the area, the higher the efficiency of the system due to partial attenuation in the sound path. As a result of this partial attenuation, the returning sound wave will include less energy and will have a smaller cancelling effect on the subsequent sound wave. Further, the configuration or cross-sectional shape can also impact the efficiency of the sound chamber. Nonetheless, even though the cross-sectional area in this application is discussed to be uniform, it is not necessary that the cross-sectional area be exactly uniform. As can be appreciated, manufacturing tolerances will create differences in the area since it is difficult and expensive to produce true uniform configurations. Further, other factors such as flow path configurations may dictate that a different dimensional area is necessary to achieve the desired flow. Thus, while the dimensional cross-sectional area may vary, a uniform "effective" cross-sectional area may be achieved such that there is uniform flow characteristic even if the configuration of the flow path changes along the path. A good example of this is shown in FIG. 4 wherein flow path sections W-Z have corresponding cross-sectional areas A1-A4 that have a generally uniform "effective" cross-sectional area. However, section W has a larger dimensional cross-sectional area than sections X-Z which can produce a loss of efficiency due to partial attenuation. In this respect, section W has a cross-sectional configuration that is partially formed by passage pipe 12. However, even with this loss of efficiency, the sound chamber can be adjusted to attenuate substantial sound waves.

With respect to FIGS. 1-4, exhaust gases EG from the internal combustion engine are exhausted as pulses of gas under pressure determined by the engine's timing control and the opening and closing of intake and exhaust valves. The pressure pulse produced by the gases exhausted through the exhaust valves carries a wave front which travels through the exhaust system and dissipates in three dimensional expansion. Whenever an obstruction is encountered by the pulse wave, sound waves having a frequency spectrum or a wide range of frequencies will be transmitted, reflected or absorbed.

When the exhaust gases travel through pipe 12, they will first encounter tubes 80, 82 and then slots 44 and 46 wherein they will be in fluid connection with the pressurized sound passage chambers 30, 40 and 42, respectively. These are pressurized chambers since they are closed. When the sound waves meet these obstructions, the sound wave will travel through the tubes and the slots into the respective sound passages.

With respect to sound passage 40, the sound wave will travel through the sound passages until it meets stop plate or end wall 110 and it will then be reversed in direction and travel and then exit back through slot 44. Similarly, the sound wave entering slot 46 of sound chamber 42 will travel through the sound chamber until it engages end plate 66 wherein it will be reversed and pass back through the sound chamber until it exits slot 46. With respect to sound chamber 30, the wave will enter the sound chamber through multiple openings and will travel through this chamber dependent on the sound dissipating method that is used therein. As is discussed above, this can be sound attenuation and also could be sound dissipation through means such as glass fill packing.

With respect to the sound attenuation of chambers 40 and 42, and possibly chamber 30, the reversing sound wave that exits the sound chamber will cancel at least a portion of a subsequent sound wave travelling through the muffler system. This has been found to greatly reduce the sound produced by an internal combustion engine. However, the frequency of the sound that is reduced is limited wherein the use of multiple sound chambers can be utilized to reduce the sound waves of a greater range of frequencies.

While slots 44 and 46 are shown to be positioned in sound vessel 20 nearest inlet 14, the location of the slots can be positioned anywhere along the through pipe within the sound chamber. As can be appreciated, this could be utilized to further change the length of the respective sound passageway based on the frequency of wave to be attenuated. Further, slots 44, 46 do not need to be adjacent one another.

As is known, the frequency or period of this sinusoidal sound curve is a function of the admitted sound. High pitched sounds have waves with short periods and high frequencies and low pitched sounds have long periods and low frequencies. Low pitched exhaust sounds are typically those which are objectionable. When the sound wave travels through a sound passage such as 40*a* and 42*a* and strikes the stop plate sections 110 and 66 respectively, it is reversed. More particularly, the sound wave is reflected back by these stop plates and if the axial length of passages 40*a* and/or 42*a* is matched to the quarter period of a given sound wave (i.e., period× speed=distance) it becomes possible to produce a reflective sound wave which has its phase shifted 180°. The reflected sound wave thus cancels out or attenuates or dampens an incoming sound wave in through pipe 12. Assuming that the sound wave was perfectly attenuated by the reflected wave, the wave would be cancelled. However, because of the presence of harmonics, the reflecting wave can never totally cancel or mute the incoming sound wave. However, the largest order of sound magnitude can be cancelled. Generally speaking, the energy or amplitude of these waves is less than the attenuated sound waves and, thus, the noise is reduced.

With respect to muffler 10, three ranges of frequencies can be attenuated by this muffler arrangement and it is more compact than the muffler arrangements in the past. In this respect, the first and second sound chambers can be positioned parallel to one another instead of axially spaced from one another which greatly reduces the axial length of the combined sound chambers. In addition, since the sound chambers are parallely spaced on either side of through pipe 12, the overall height of the flow chambers can be reduced. As a result of this configuration, both the length and the height of the muffler arrangement can be greatly reduced without affecting the performance of the muffler system. Yet even further, simplified manufacturing techniques can be utilized wherein the spacing of the dividers 50, 52, 54, 60, 62 and 64 can be maintained by the interengagement between the edges of these plates and the outer housing of the inner sound vessel. Spacers are not necessary to maintain proper gap and structural integrity of these sound passages within these chambers. Overall, the same performance can be produced by a muffler system having reduced parts and, therefore, reduced weight.

Figure 5:
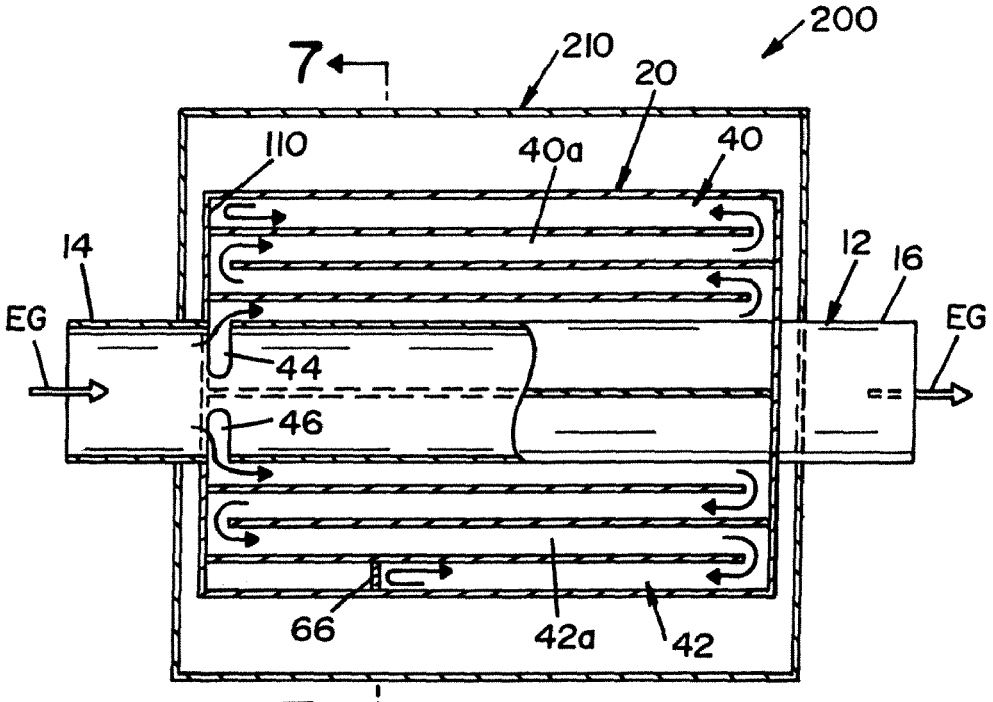
FIG. 5 is a top sectional view of another embodiment of the muffler of the present invention which does not include an outer sound chamber.
Figure 6:
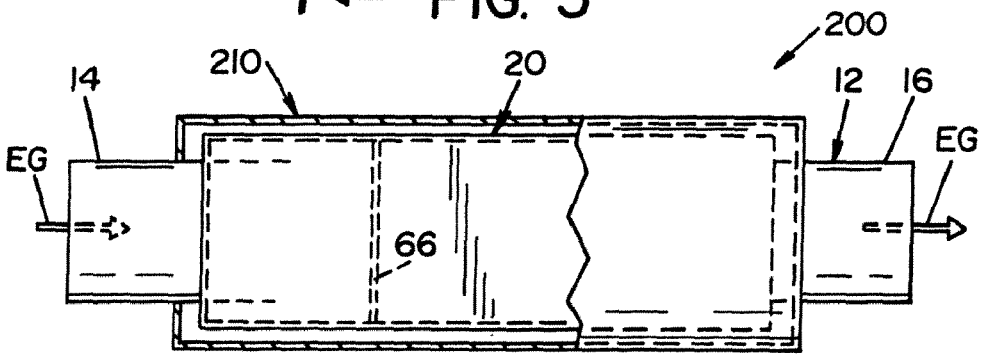
FIG. 6 is a side view, partially in section, of the muffler shown in FIG. 5.
Figure 7:
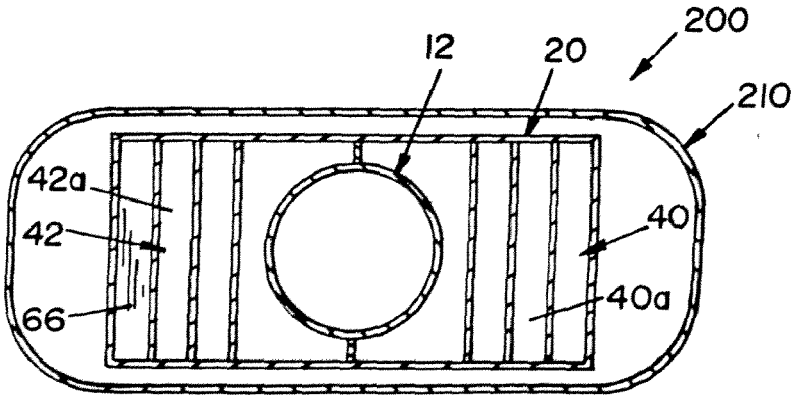
FIG. 7 is a sectional view taken along lines 7-7 in FIG. 5.
Figure 8A:
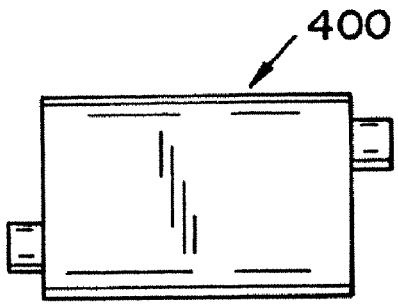
FIGS. 8*a*-8*e* are several top views of the overall outer configurations of mufflers according to the present invention.
Figure 8B:
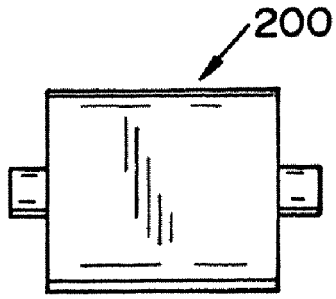
Figure 8C:
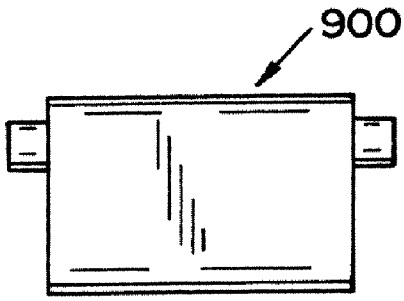
Figure 8D:
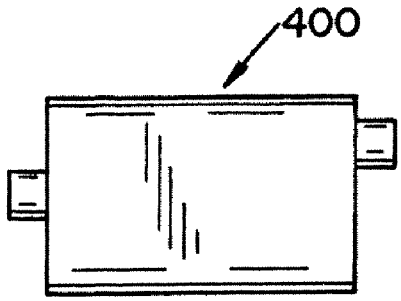
Figure 8E:
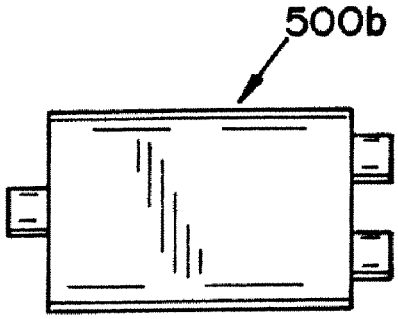

With reference to FIGS. 5-7, shown is a muffler 200 which includes inner sound chambers that can be the same or similar to muffler 10 described above. However, muffler 200 does not include an outer sound chamber. As can be appreciated, based on the sound to be dampened, a muffler according to the present invention can be limited to inner sound chambers that attenuate the sound waves produced by the internal combustion engine. In this particular embodiment, housing 210 is primarily structural and can be used to help secure muffler 200 within the exhaust system. Since the configurations of chambers 40 and 42 are discussed above, they will not be discussed with respect to this embodiment. Further, it should be noted that different length chambers could be used for sound chambers 40 and/or 42 in this embodiment and others without detracting from the invention of this application. Further, length and width limitations can be addressed by adding and/or removing partitions.

As can be appreciated, since the muffler does not include an outer sand chamber, housing 210 can be eliminated in one embodiment. While the outer housing can be utilized to further deaden sound and/or to provide a structural outer layer, the present invention can be formed by an inner vessel that can be structurally designed to support the vessel to the vehicle exhaust system. Further, while not shown, the outer layer can be formed in other configurations such as an enlarged rectangular configuration similar to the outer walls of inner vessel 20. Since the sound attenuation of this embodiment is similar to those in embodiments discussed above, the particulars will not be discussed in connection with this embodiment. However, as can be appreciated, one or more of the attenuation configurations described above or below can be utilized in this muffler arrangement wherein the housing is integral with the sound vessel.

With reference to FIGS. 8*a*-8*e*, shown are some of the many muffler configurations that are possible with the side branch muffler design of this application which were not possible utilizing prior art techniques of sound attenuation. Some of these other configurations will be discussed in greater detail below.

Figure 9:
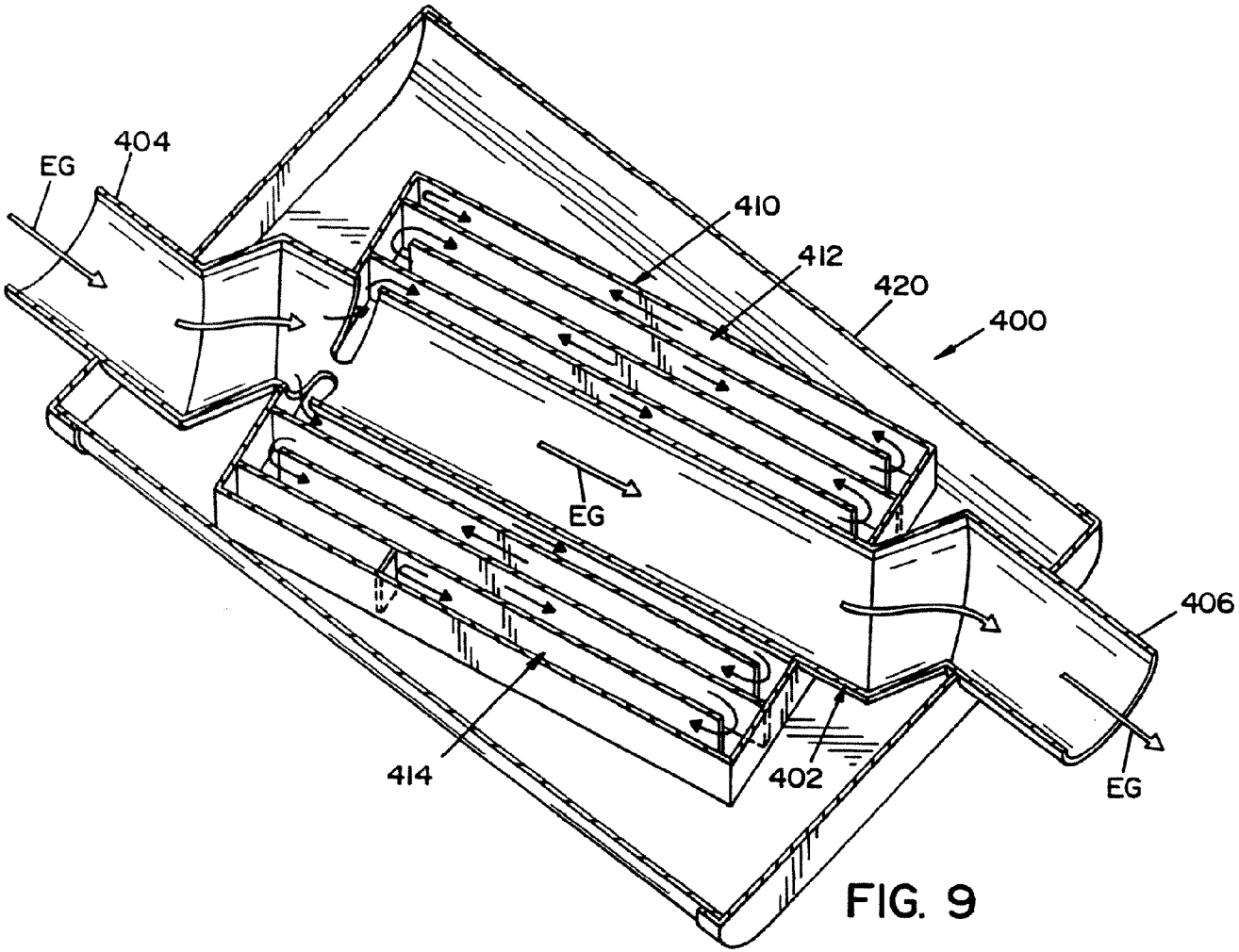
FIG. 9 is a perspective view, in section, of yet another embodiment of the present invention including a differently configured inner sound vessel wherein the inlet pipe is offset from the outlet.

FIG. 9 shows a muffler 400 having an offset through pipe 402 with an inlet 404 and an outlet 406. Muffler 400 further includes an inner sound vessel 410 that includes sound chambers 412 and 414. Inner sound vessel 410 is surrounded, in this embodiment, by an outer housing 420 that is not in fluid connection with exhaust EG. As with other embodiments, housing 420 can include mounting structures to secure muffler 400 in proper position on a vehicle of choice. The offset configuration of through pipe allows the muffler to have an offset configuration design for certain vehicles needing an offset muffler. As a result, sound chambers 412 and 414 of inner sound chamber 410 are angled relative to housing 420. The sound attenuation of muffler 400 functions similar to those discussed above and therefore, will not be discussed in detail. Further, while not shown, this sound configuration can have other arrangements discussed in this application including, but not limited to, an outer housing in fluid communication with passage 402 wherein housing can be a "functional" housing.

Figure 10A:
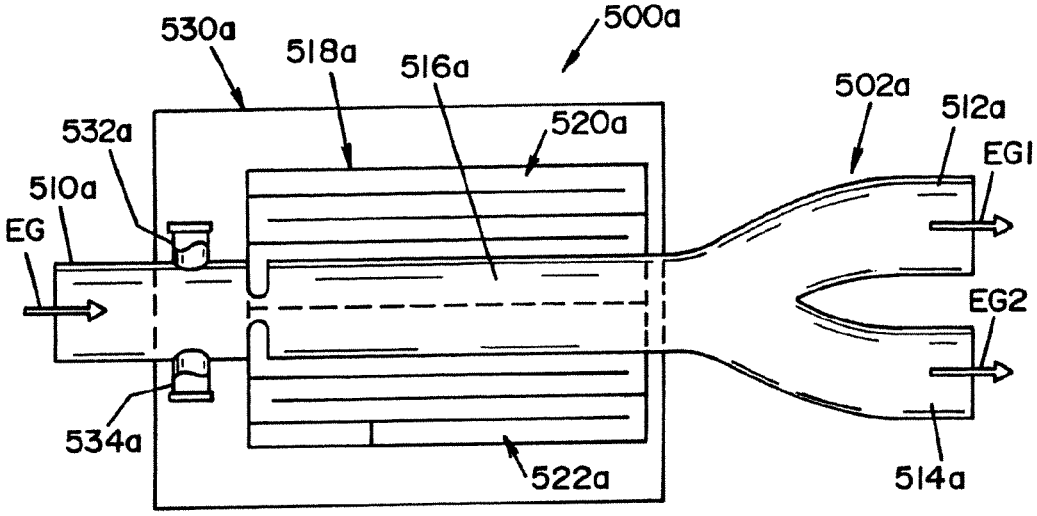
FIGS. 10*a* and 10*b* are top views of a further embodiment of the present invention including multiple outlets.
Figure 10B:
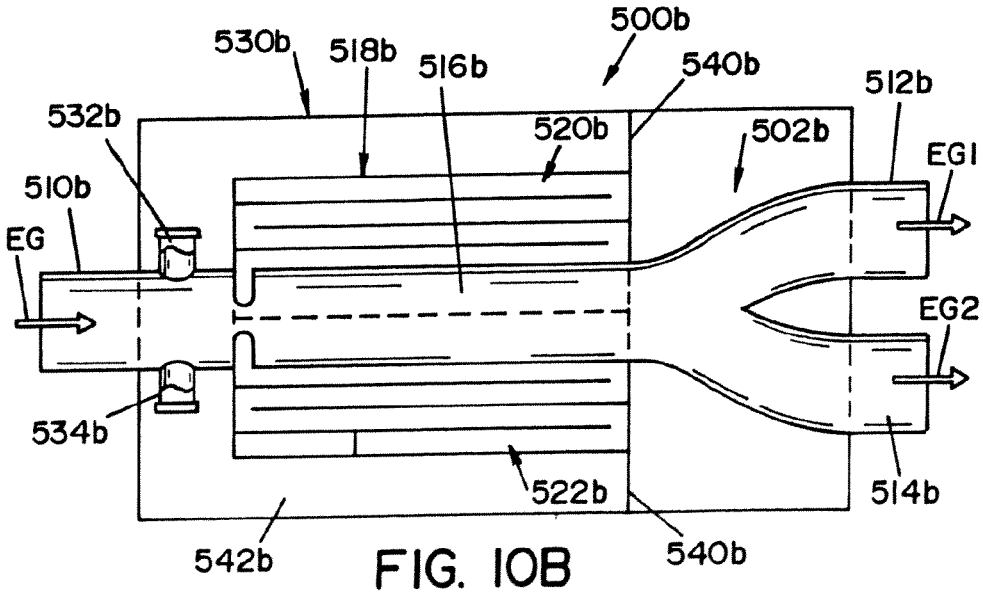

With reference to FIGS. 10*a* and 10*b*, shown are yet further embodiments of this application. In this respect a muffler according to the present invention can have any one of a number of configurations to allow it to be utilized in a wide range of vehicles. FIGS. 10*a* and 10*b* show mufflers 500*a* and 500*b* both having splitters to form dual outlets. More particularly, muffler 500*a* has a splitter 502*a* producing a muffler with a single inlet 510*a* and dual outlets 512*a* and 514*a*. Splitter 502*a* is an external splitter that is permanently joined to a passage 516*a* of muffler 500*a*. With respect to the remaining portions of muffler 500*a*, it can be configured according to any one of the arrangements discussed in this application including, but not limited to, having an internal sound vessel 518*a* with two sound chambers 520*a* and 522*a* spaced on either side of passage 516*a*. Muffler 500*a* can further include an outer housing 530*a* that is an outer sound chamber having connectors 532*a* and 534*a* in fluid communication with passage 516*a*. As can be appreciated, splitter 502*a* could be attached to the remaining portions at any time including during the installation of muffler 500*a* on a vehicle (not shown).

Muffler 500*b* also includes a splitter 502*b*; however, splitter 502*b* is an internal splitter positioned at least partially within a housing 530*b*. More particularly, muffler 500*b* has a splitter 502*b* producing a muffler with a single inlet 510*b* and dual outlets 512*b* and 514*b*. But, splitter 502*b* is an internal splitter that is permanently joined to a passage 516*b* of muffler 500*b* within housing 530*b*. With respect to the remaining portions of muffler 500*b*, it can be configured according to any one of the arrangements discussed in this application including, but not limited to, having an internal sound vessel 518*b* with two sound chambers 520*b* and 522*b* spaced on either side of passage 516*b*. Muffler 500*b* can further include an outer housing 530*b* that is an outer sound chamber having connectors 532*b* and 534*b* in fluid communication with passage 516*b*. Further, muffler 500*b*, or any other muffler of this application, can also include an internal barrier 540*b* that divides the inner volume of chamber 530*b* into a smaller volume. The use of internal barriers can be used for any one of a number of reasons including, but not limited to, producing a desired volume in a region 542*b* of sound chamber 530*b* to tune it to a particular frequency, or range of frequencies.

Figure 11:
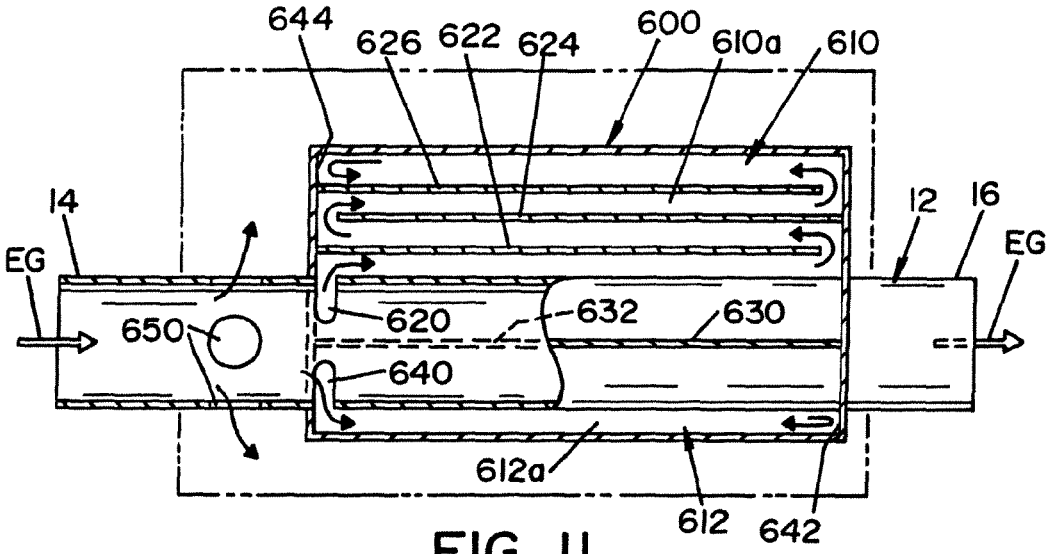
FIG. 11 is a top sectional view of yet another embodiment of the present invention including an inner vessel and both inner and outer sound chambers.

With reference to FIG. 11, an inner sound vessel 600 is shown. Sound vessel 600 includes a first sound chamber 610 and a second sound chamber 612. First sound chamber is in fluid connection with through pipe 12 via opening 620 and includes partitions 622, 624 and 626 thereby producing flow path 610*a*. Sound chamber 610 is separated from sound chamber 612 by ribs 630 and 632. Sound chamber 612 includes a slot or opening 640 for the fluid connection between the through pipe and the sound chamber. Sound chamber 612 extends between opening 640 and a stop plate 642 wherein flow passage 612*a* is much shorter than flow passage 610*a* that extends between opening 620 and stop wall 644. Through pipe 12 in this arrangement includes opening 650 for the fluid connection between the through pipe and an outer sound chamber (shown in phantom). As with other embodiments in this application, the inner sound vessel can be used with or without an outer sound chamber.

Figure 12:
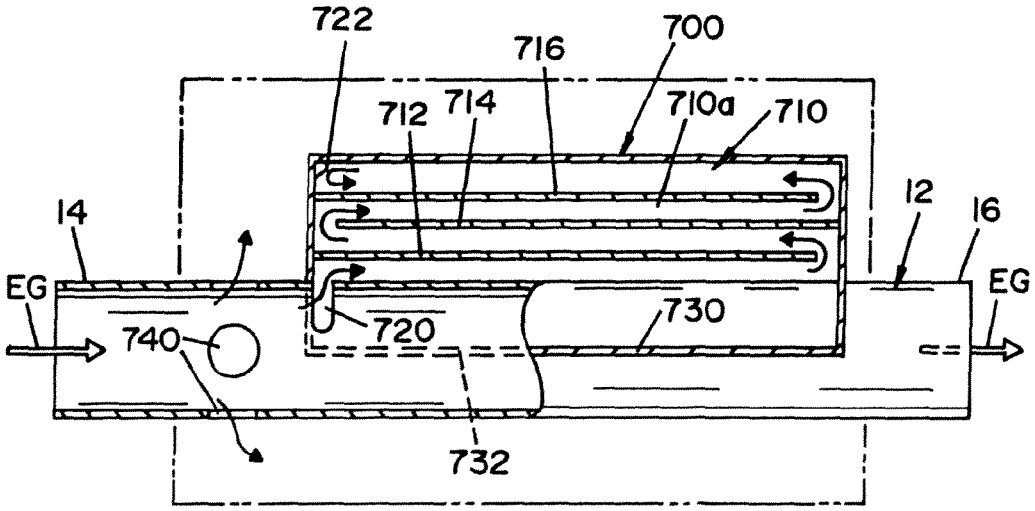
FIG. 12 is a top sectional view of another embodiment of the present invention including a single inner sound chamber along with openings to an outer chamber.

FIG. 12 shows an inner sound vessel 700 that includes a single sound chamber 710. As is discussed above, the inner sound vessel can include one or more separate and/or connected sound chambers. While it may be preferred that two inner sound chambers are utilized, one sound chamber or more than two sound chambers can be utilized in accordance with the invention of this application. Sound chamber 710 includes partitions 712, 714 and 716 which in part define sound passage 710*a* that extends between opening 720 and a stop plate 722. As with other embodiments in this application, the length of the sound passage 710*a* can be modified by using more or less partitions and/or changing the overall length of the sound vessel. In this particular embodiment, ribs 730 and 732 are utilized to help separate inner chamber and vessel 700 from the outer chamber which is not shown. This arrangement can include openings 740 for the fluid connection between the through pipe 12 and the optional outer sound chamber.

Figure 13:
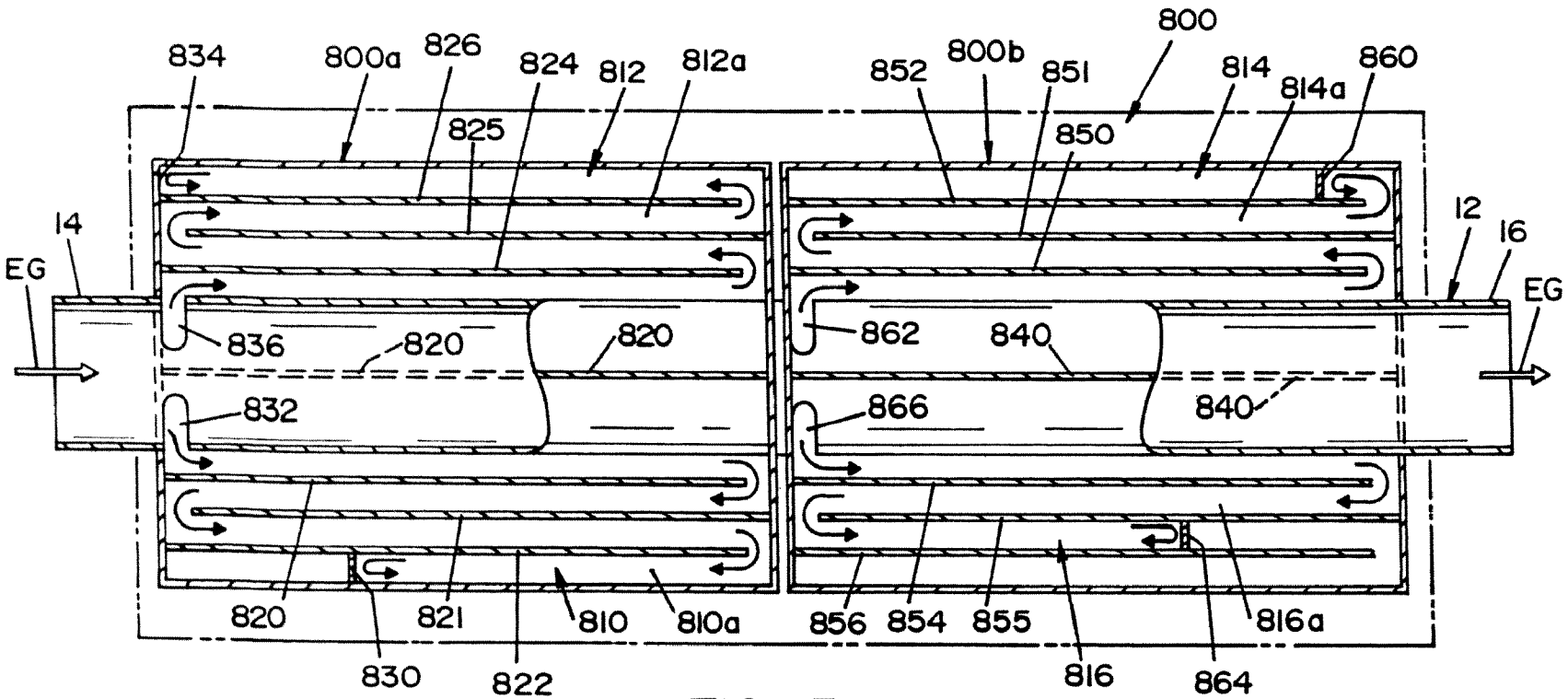
FIG. 13 is a top sectional view of yet another embodiment according to the present invention showing an inner sound vessel that includes four sound chambers.

FIG. 13 shows a sound vessel 800 that includes four sound chambers, namely sound chambers 810, 812, 814 and 816. As is discussed above, the number of sound chambers can be from 1 to as many as is needed to attenuate the desired range of frequencies. This embodiment shows four sound chambers including two pairs of axially spaced chambers on either side of through pipe 12. As with other embodiments in this application, the sound vessel could be formed with an outer layer that is designed to be the outer layer of a muffler. Conversely, vessel 800 could be the inner portion of a muffler wherein a functional or non functional outer layer (shown in phantom) is utilized. In this Figure, vessel 800 is configured for an outer layer that is not designed for reactive sound deadening. Furthermore, the functional outer layer could also have connectors or inlet tube(s) joined to the through pipe or passage 12 at any position along this pipe. More particularly, vessel 800 includes two sub-vessels 800*a* and 800*b* that are shown to be separate vessels that are axially spaced along passage 12. The inlet tube(s) could be upstream of sub-vessels 800*a*, between sub-vessels 800*a* and 800*b* or downstream of sub-vessels 800*b* without detracting from the invention in this application. Yet even further, this embodiment and others in this application can include multiple tanks and multiple sets of inlet tube(s).

With reference to the shown embodiment, the sub-vessels are separate vessels adjacent one another. However, as can be appreciated, sub-vessels 800*a* and 800*b* could be formed from common outer walls with a spacer within the common outer walls to separate the two sub-vessels. Further, while two sub-vessels are shown, this application is not to be limited to two sub-vessels. In these other embodiments, the inlet tube(s) referenced above could be between any of these additional sub-vessels. Yet even further, sub vessels 800*a* and 800*b* could be a different size such as, for example, a different length. Sub vessel 800*a* includes chambers 810 and 812 that are spaced on either side of through pipe 12 and these chambers can be isolated from one another by ribs 820 wherein ribs 820 extend the length of the sub-vessel. Chamber 810 includes partitions 820-822 and chamber 812 includes partitions 824-826. These partitions, in part, form flow passages 810*a* and 812*a*, respectively. The lengths of flow paths 810*a* and 812*a* are controlled, in this embodiment, by the placement of the stop plates. More particularly, chamber 810 includes a stop plate 830 and through pipe 12 includes an opening 832 in fluid communication with flow passage 810*a* such that flow passage 810*a* extends between opening 832 and stop plate 830. Similarly, chamber 812 includes a stop plate 834 and through pipe 12 includes an opening 836 in fluid communication with flow passage 812*a* such that flow passage 812*a* extends between opening 836 and stop plate 834. In view of the placement of stop plate 830, flow path 810*a* is shorter than flow path 812*a* wherein chamber 810 will attenuate a shorter wave length than chamber 812.

Sub vessel 800*b* includes chambers 814 and 816 that are also spaced on either side of through pipe 12 and these chambers can be isolated from one another by ribs 840 wherein ribs 840 extend the length of the sub-vessel. Chamber 814 includes partitions 850-852 and chamber 816 includes partitions 854-856. These partitions, in part, form flow passages 814*a* and 816*a*, respectively. The lengths of flow paths 814*a* and 816*a* are controlled, in this embodiment, by the placement of the stop plates. More particularly, chamber 814 includes a stop plate 860 and through pipe 12 includes an opening 862 in fluid communication with flow passage 814*a* such that flow passage 814*a* extends between opening 862 and stop plate 860. Similarly, chamber 816 includes a stop plate 864 and through pipe 12 includes an opening 866 in fluid communication with flow passage 816*a* such that flow passage 816*a* extends between opening 866 and stop plate 864. In view of the placement of stop plate 864, flow path 816*a* is shorter than flow path 814*a* wherein chamber 816 will attenuate a sound wave with a shorter wave length than chamber 814. Further, flow path 814*a* is shorter than flow paths 810*a* and 812*a* wherein chamber 814 will attenuate a sound wave with a shorter wave length than chamber 810 and 812. In all, the lengths of the respective flow paths are all different such that vessel 800 will attenuate an even greater range of sound waves. As can be appreciated, the outer housing (shown in phantom) could be used to further deaden sound.

Figure 14:
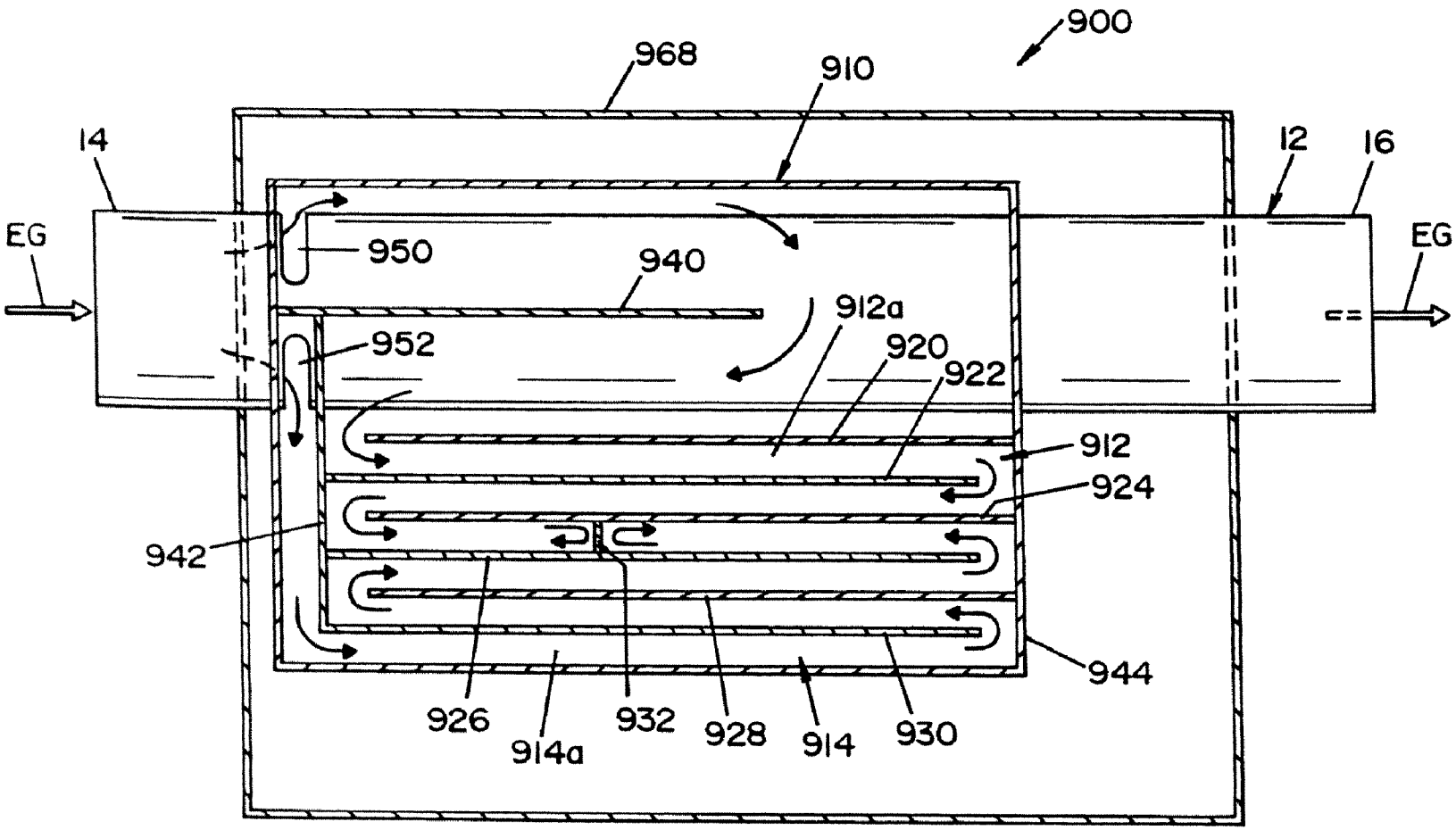
FIG. 14 is a top sectional view of yet another embodiment of the invention of this application with a cross over sound chamber.

FIG. 14 shows a muffler 900 which includes an inner sound vessel 910 having two sound chambers 912 and 914 that are on the same side of through pipe 12. In this respect, the invention of this application is not limited to inner sound vessels having only single sound chambers on each side of the through pipe. Different fluid connections can be utilized to allow multiple sound chambers on one or both sides of the through pipe which allows the muffler according to the present invention to be used in connection with an even greater range of vehicles. As is discussed above, different vehicles can have very different space limitations for the placement of the muffler system. The result of these limitations can create a situation where the through pipe must be spaced on one side of the muffler as opposed to a central placement of the through pipe. Further, many muffler systems have an offset design wherein the inlet of the through pipe is on one side of the muffler while the outlet of the through pipe is on the opposite side of the through pipe. These different restrictions can dictate the shape of the muffler wherein flexibility on the placement of the sound chambers can be the difference between the muffler fitting in a certain application and performing as needed and not selling a muffler for a particular vehicle.

In greater detail, inner vessel 910 includes partitions 920, 922, 924, 926, 928 and 930. Vessel 910 further includes a stop plate 932; however, stop plate 932 is a stop plate for both sound chambers 912 and 914. Vessel 910 further includes a top rib 940 and a similar bottom rib (not shown). In addition, vessel 910 includes an inner wall 942 inwardly spaced from vessel box 944. As is discussed in other portions of this application, while the drawings of this application show particular configurations for the outer housing and the vessel box, the invention of this application should not be limited to these configurations and can include modifications to the shapes and sizes described herein without detracting from the invention of this application.

The two chamber system within vessel 910 is in fluid communication with the exhaust gas in the through pipe by way of openings 950 and 952. As with other embodiments in this application, the sizing of these openings are based on the cross-sectional area of the respective flow paths 912*a* and 914*a* such that the sound wave is allowed to freely move within the flow paths which minimizes unwanted harmonics. It has been found that an opening that is at least 70% of the cross-sectional area of flow path 12 or exhaust pipe area works best. With respect to sound chamber 912 and flow path 912*a*, waves from exhaust gas EG enters this chamber by way of opening 950 and passes between the surface of the through pipe, vessel box 944 and rib 940. Then, since ribs 940 are shortened ribs that do not extend from box wall to box wall, the exhaust gas waves are allowed to cross over through pipe 12 and engages partition 920 wherein its direction is reversed. The exhaust gas then is directed through flow path 912*a* by partitions 920, 922, 924 and 926 until it engages a stop plate 932 wherein the direction is reversed. The sound wave then retraces its path through flow path 912*a* until it re-enters through pipe 12 via opening 950. If the length of 912*a* is set correctly, the sound or fluid pulse re-entering the flow pipe will at least partially cancel a subsequent sound wave. This process produces attenuation.

With respect to sound chamber 914 and flow path 914*a*, exhaust gas waves enter sound chamber 914 via opening 952. The exhaust gas is then directed along the edge of vessel 910 by vessel box 944 and internal wall 942. When the wave reaches the corner of box 944, it is redirected along partition 930 based on the engagement between box 944 and the partition. The flow of this wave is then directed between the partitions until it reaches stop plate 932 wherein it is redirected back along the same flow path so that it can re-enter through pipe 12 and attenuate a subsequent wave.

While not shown, muffler 900 can also include an outer sound chamber. Further, as with all embodiments in this application, the muffler can include additional inner and outer sound chambers including inner chambers axially spaced from chamber 912 and 914. In this respect, a second inner vessel (not shown) could be positioned downstream of vessel 910 within outer housing 968 thereby allowing the attenuation of yet even further frequencies. Similarly, the outer housing can have more than one outer sound chamber without detracting from the invention of this application. As can be appreciated, the number of chambers and the position of the chambers are not limited and can change significantly based on the vehicle in which the device is used. Furthermore, an exhaust system according to the present invention can also include multiple muffler systems spaced from one another in the exhaust system. This particular arrangement could be used in view of space limitations or even to achieve a desired sound from the exhaust gas. Furthermore, the slots or opening to create the fluid connection between the through pipe and the respective sound chamber can have many configurations and can be positioned in different locations. In this respect, while the drawings of this application show the slots to be radially spaced from one another, they can also be axially spaced such that (for example) slots 950 could be axially spaced from slot 952 on the opposite side of inner wall 942 without detracting from the invention of this application.

FIGS. 15-20 show a particular method of fabricating the inner vessels according to the present invention. As is discussed above, these inner vessels can have many different configurations without detracting from the invention of this application. Further, the inner vessels of this application can be manufactured by any manufacturing technique known in the art. It has been found that formed and welded sheet stock material can be utilized to fabricate the inner vessel structure. As is known in the art, the materials used to fabricate this box structure can include stainless steel. It has been found that 400 Series stainless steels work particularly well for this application. However, the invention of this application is not to be limited to stainless steel and any material currently known in the art could be used and future materials could also be used without detracting from the invention of this application.

Figure 15:
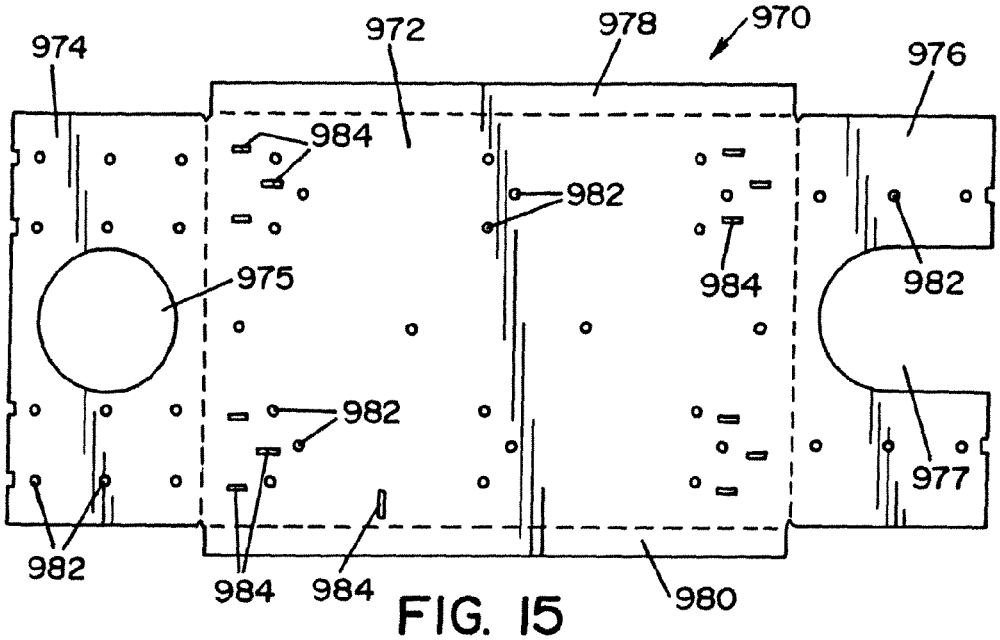
FIG. 15 is a top view of the cut sheet stock used to form the base and two sides of the inner sound vessel.
Figure 16:
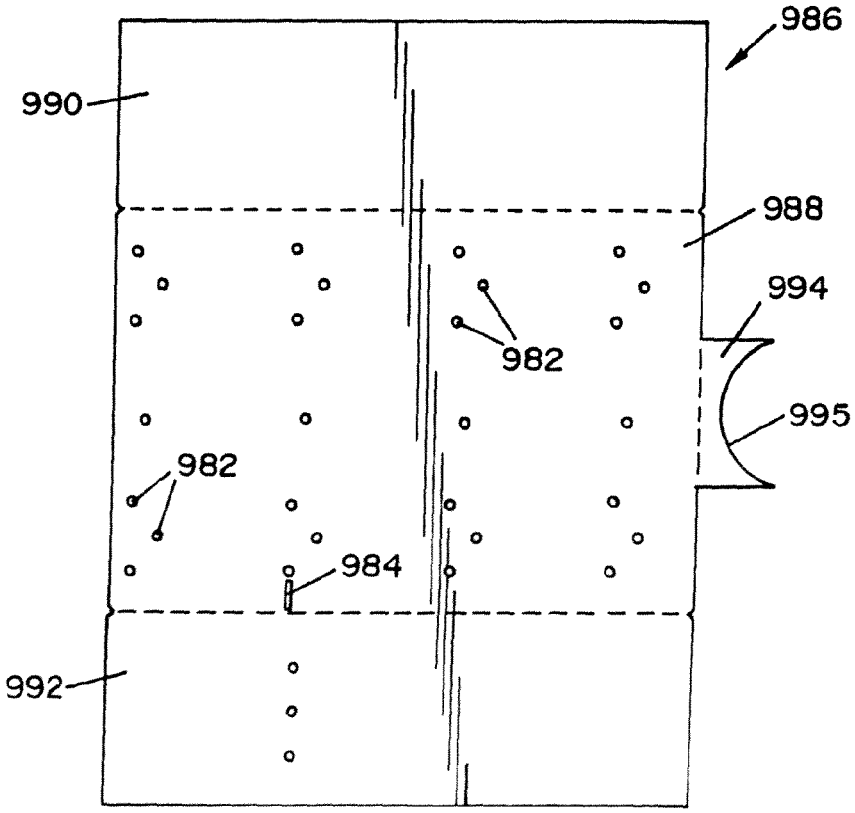
FIG. 16 is a top view of the cut sheet stock used to form the top and two sides of the inner sound vessel.

FIGS. 15-20 show six different components utilized to create a vessel such as vessel 20. FIGS. 15 and 16 show the outer box structural components before these components have been formed. In this respect, FIG. 15 shows component 970 which includes base section 972 and ends 974 and 976.

End section 974 includes a through pipe opening 975 and end section 976 includes a through pipe slot 977. Component 970 further includes tabs 978, 980. In addition, this component includes a plurality of weld openings 982 and guide slots 984 that are utilized to help position the internal components within the outer box structure during manufacturing. This sheet is formed such that it is bent 90° about the dashed lines. Similarly, component 986 (FIG. 16) includes a top section 988, a side section 990 and a side section 992 along with a through pipe tab 994. Tab 994 includes a curved end portion 995 that works in connection with slot 977 of component 970 to allow through pipe 12 to extend through vessel 20 by way of opening 975 and the opening produced by slots 977 and 995.

Any technique known in the art can be utilized to produce the necessary seals between the through pipe and these openings within the vessel. Further, as is discussed above, the opening sizes in vessel 20 are dictated by the particular diameter of through pipe that is to be utilized in the exhaust system. The size of the through pipe is dictated by the internal combustion engine of the vehicle for the particular application. As with component 970, component 986 includes welding holes 982 and alignment slots 984 wherein this component is also bent 90° about the dashed lines. Components 970 and 986 are configured to be joined together to form the outer box structure of an inner vessel such as inner vessel 20.

Figure 17:
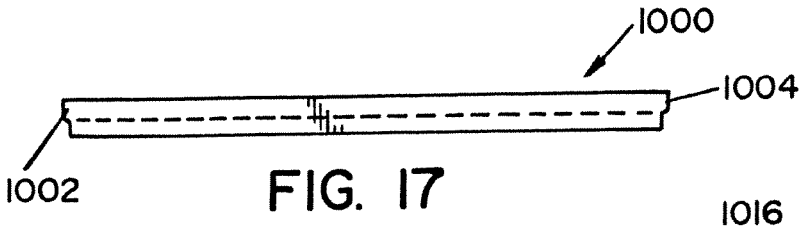
FIG. 17 is a top view of a rib used in the inner sound vessel.

FIG. 17 shows a rib 1000 extending between an end 1002 and an end 1004 that defines a rib length. In this particular vessel configuration, the length of rib 1000 corresponds with the length of base section 972 of component 970. This configuration of rib can be utilized to separate the vessel into two sound chambers spaced on either side of the through pipe.

Figure 18:
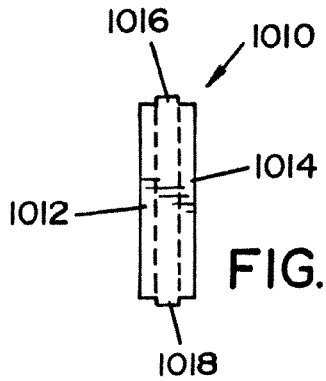
FIG. 18 is a side view of a stop plate used in the inner sound vessel.

FIG. 18 is a side view of a stop plate 1010 having side tabs 1012, 1014 along with a top tab 1016 and a bottom tab 1018. Plate 1010 can be utilized to adjust the length of a particular flow path to attenuate a desired frequency of wave form. As can be appreciated, in applications wherein the sound chambers are equally sized on either side of the through pipe, the flow path for both sound chambers would be equal if the same number of partitions were used. As a result, the sound attenuation would then be the same for both chambers. By including end plate 1010 in one of the sound chambers, the particular sound passage can be shortened to change the frequency of wave that is attenuated by that sound chamber. As with the other components, this sheet stock is formed 90° or bent about the dashed lines and end tabs 1012, 1014 can be utilized as welding tabs to secure this end plate to a particular set of partitions and to the outer box. Tabs 1016 and 1018 can also be utilized to help align the end plate within the sound chamber wherein it can be positioned in the alignment slots, such as slots 984, to produce a manufacturable product that has high repeatability.

Figure 19:
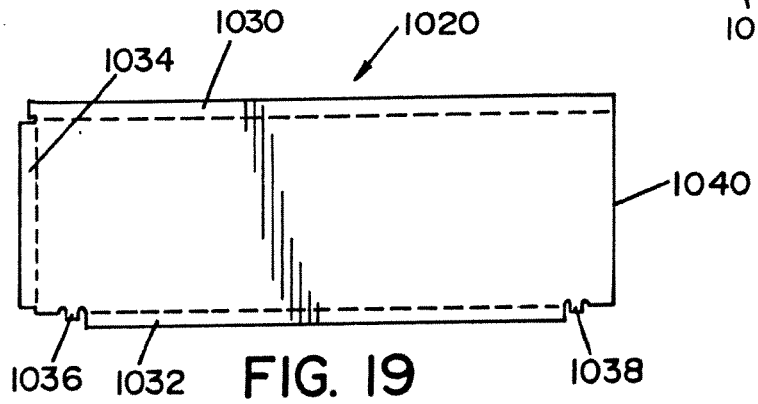
FIG. 19 is a side view of a partition used in the inner sound vessel.
Figure 20:
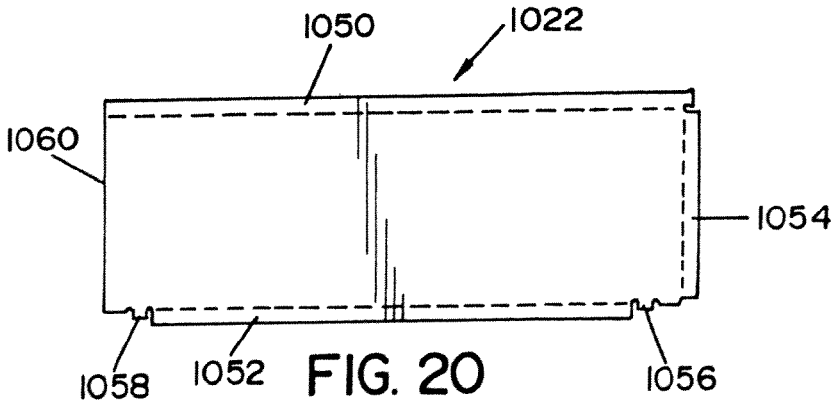
FIG. 20 is a side view of another partition used in the inner sound vessel.

FIGS. 19 and 20 show partitions 1020 and 1022. These partitions are similarly configured and are used in combination with one another to extend the length of the flow path of the sound chamber. Partition 1020 has a top tab 1030, a bottom tab 1032 and a front tab 1034 along with alignment tabs 1036, 1038. Partition 1020 is formed about the dashed lines and is placed within vessel 20 such that tab 1034 is attached to front section 974 of component 970. The length of partition 1030 produces a gap between a rear edge 1040 of partition 1030 and rear section 976 of component 970. For example, partition 50 of chamber 20 could be produced by partition 1030.

Partition 1022 has top tab 1050, bottom tab 1052 and rear tab 1054 along with alignment tabs 1056, 1058. Partition 1020 is formed about the dashed line and is placed within vessel 20 such that tab 1054 is attached to rear section 976 of component 970. The length of partition 1050 produces a gap between a front edge 1060 of partition 1050 and front section 974 of component 970. For example, partition 52 of chamber 20 could be formed by partition 1022.

As can be appreciated, the number of components including the number of partitions is based on the length of the flow path necessary to attenuate the desired frequency and the length of the vessel. As the wave length increases, the flow path also needs to increase to produce attenuation of the desired sound. Again, the materials utilized to make the components in FIGS. 15-20 and in the other Figures in this application can be any materials known in the art including, but not limited to, the 400 Series stainless steel discussed above. Further, these components are joined to one another utilizing any known manufacturing techniques in the art including welding the components by conventional welding techniques. Openings 982 can be utilized for the welding process according to techniques known in the art.

Figure 21:
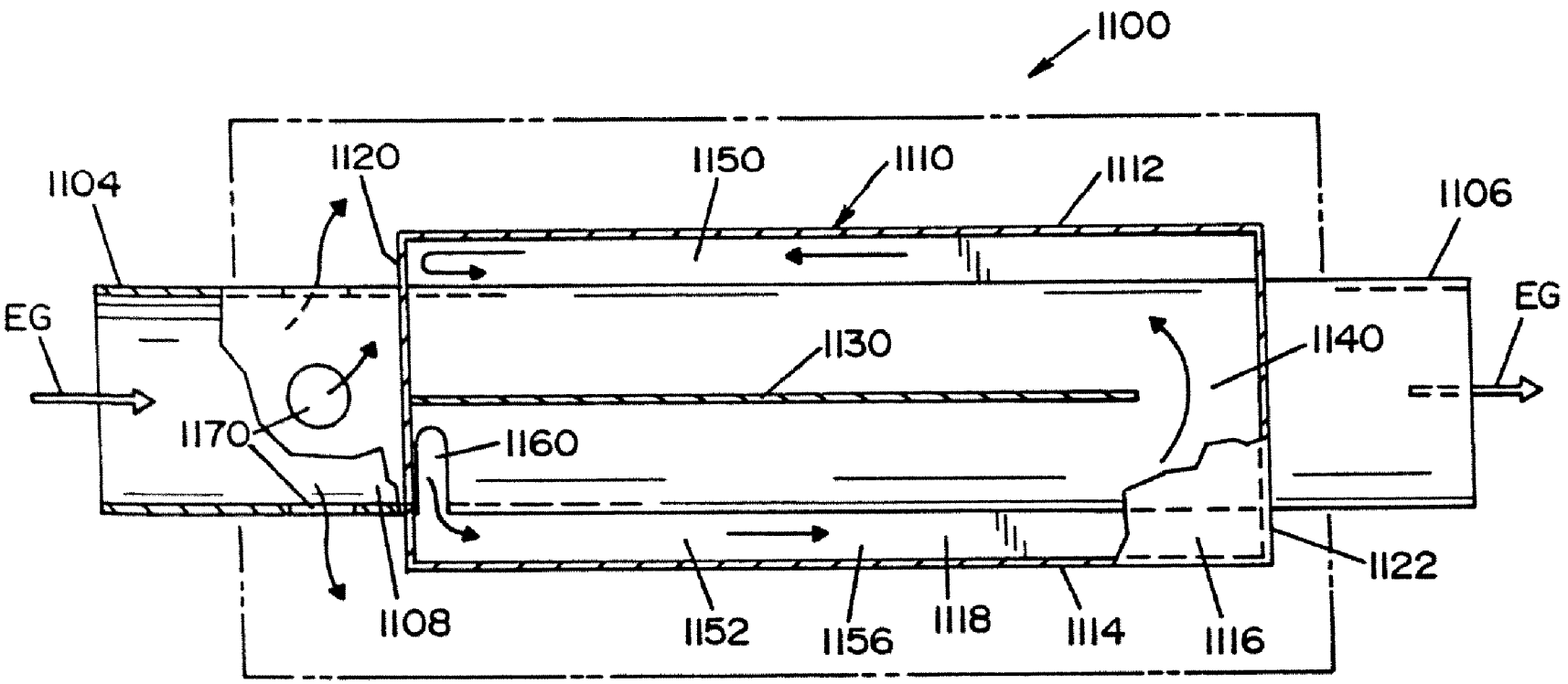
FIG. 21 is a top sectional view of yet a further embodiment of the invention of this application with a further cross over style sound chamber.

FIG. 21 shows a muffler 1100 which includes an inner sound vessel 1110 having a single sound chamber. In this respect, muffler 1100 includes an inlet 1104 and an outlet 1106 connected by a passage 1108 extending through inner sound vessel 1110. Inner sound vessel 1110 of muffler 1100 includes side walls 1112, 1114 that are parallel to one another; a top wall 1116 and a bottom wall 1118 that are parallel to one another and end plates 1120 and 1122 wherein end plates are joined on either end of walls 1112, 1114, 1116 and 1118. Vessel 1110 further includes a top rib 1130 and a similar bottom rib (not shown). Top and bottom ribs 1130 extend from end plate 1120 toward end plate 1122; however, the ribs are shorter than walls 1112, 1114, 1116 and 1118 such that gaps 1140 are formed between passage or through pipe 1108, top wall 1116, bottom wall 1118 and end plate 1122. Further, ribs 1130 form passages 1150 and 1152 on either side of passage 1108 that are in fluid communication with each other based on gaps 1140 thereby producing a single inner flow path 1156.

Flow path 1156 of inner vessel 1110 is in fluid communication with the exhaust gas EG in through pipe 1108 by way of an opening 1160 in passage 1152. As with other embodiments in this application, the sizing of these openings are based on the cross-sectional area of the respective flow paths such that the sound wave is allowed to freely move within the flow paths which minimizes unwanted harmonics. As the sound wave enters through opening 1160, it is directed down passage 1152 toward end plate 1122. Then, since ribs 1130 are shorter than walls 1112, 1114, 1116 and 1118, the sound waves are directed through gaps 1140, around passage 1108 and toward passage 1150. The exhaust gases are then directed down path 1150 back toward end plate 1120 until it engages end plate 1120 and is then redirected back along the same path until it again reaches opening 1160 and is reintroduced into passage 1108 to cancel a subsequent wave in the passage as is discussed above. As can be appreciated, this particular embodiment produces a longer, but narrower muffler configuration. This particular embodiment allows the muffler to be used in arrangement including, but not limited to, a side-pipe arrangement. As can also be appreciated, walls 1112, 1114, 1116 and 1118 have a common length; however, the walls do not need to have a common width wherein walls 1112 and 1114 could be narrower than walls 1116 and 1118 such that end plates 1120 and 1122 are rectangular.

Muffler 1100 can also include an outer sound chamber (shown in phantom) in fluid connection with the exhaust gasses EG by way of openings 1170 in passage 1108. Further, as with all embodiments in this application, the muffler can include additional inner and outer sound chambers including inner chambers axially spaced from the inner vessel 1110.

The remaining figures primarily relate to the tank portion of the muffler of this application. While these configurations and embodiments are discussed separately from the side branch muffler embodiments above, all embodiments of this application can be combined without detracting from the invention of this application.

Figure 22:
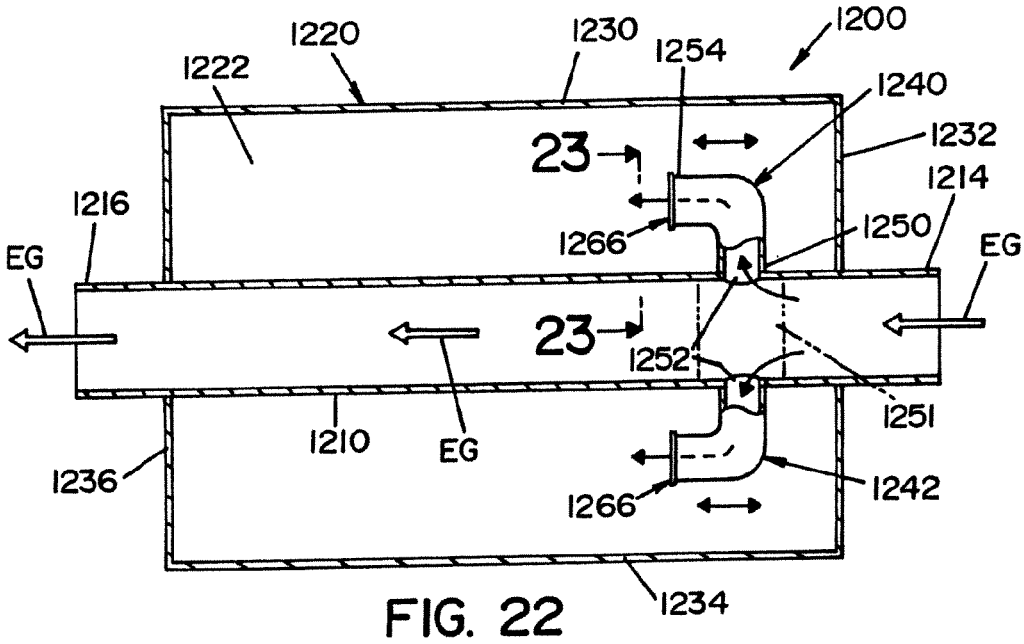
FIG. 22 is a top sectional view of a further embodiment of this application that includes a tank configuration with multiple connectors in accordance with another aspect of the invention of this application.
Figure 23:
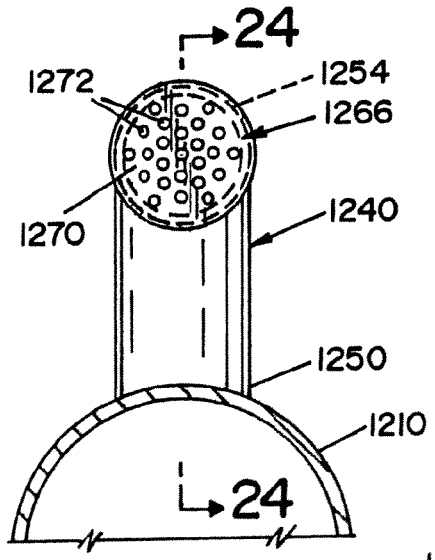
FIG. 23 is an enlarged sectional view taken along lines 23-23 in FIG. 22.
Figure 24:
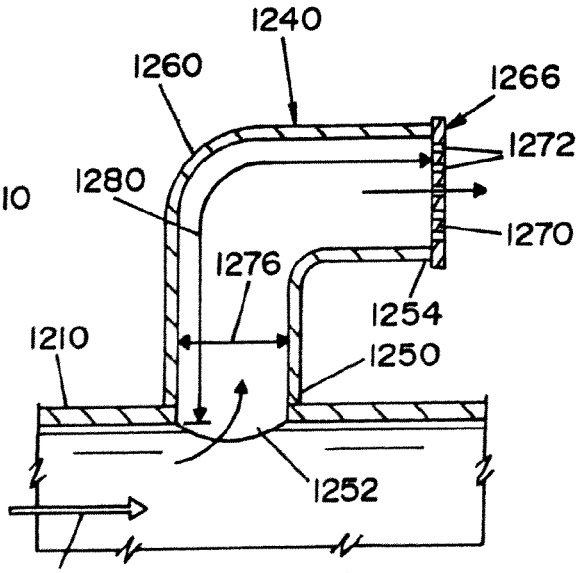
FIG. 24 is an enlarged sectional view taken along lines 24-24 in FIG. 23.

With reference to FIGS. 22-24, shown is a tank muffler 1200 having an inner passage or through pipe 1210 with an inlet 1214 and an outlet 1216 in fluid communication with the inlet. Muffler 1200 further includes a tank or outer housing 1220 wherein pipe 1210 extends through the housing. Housing or tank 1220 can be made by any known methods in the art and has an internal volume 1222 defined by the outer walls including walls 1230, 1232, 1234 and 1236. Muffler 1200 further includes two tubular connectors 1240 and 1242 having, in this embodiment, an L shaped configuration. These connectors are joined to pipe 1210 such that the connectors are in fluid communication with exhaust gases EG and allow the sound or fluid pulse to enter the tank 1220. As will be discussed in greater detail below, while only two connectors are shown, any number of connectors could be used for each tank without detracting from the invention of this application.

While not required, connectors 1240 and 1242 can be configured similarly so that each has similar flow characteristics for the sound wave which can minimize partial attenuation or the wakening of the returning sound pulse. Connectors 1240 and 1242 are both positioned in a connector region 1251 which is preferably less than 5 inches measured axially along pipe 1210. In one embodiment, the connector region is less than 3.5 inches and in another it is less than 2.5 inches. Further, the connectors in yet another embodiment are in the same plane which is transverse to the flow in pipe 1210. The connectors have an elongated or tubular connector body with a first end 1250 joined to pipe 1210 at opening 1252 and a second end 1254 spaced from the first end that is in fluid connection with tank 1220. As with all connectors of this application, these connectors can by substantially cylindrical, cylindrical, oval, or even polygonal in configuration.

In operation, the connector forms the fluid path or connection between the through pipe and the tank wherein the high pressure sound or fluid pulses can enter tank 1220 as they pass opening 1252 in pipe 1210. These pulses are then returned to the pile wherein subsequent pulses are attenuated as is discussed above in greater detail. In this embodiment, connectors 1240 and 1242 includes right angle bend 1260 such that the gases entering the tank are directed generally parallel to pipe 1210.

However, it has been found that unrestricted flow between passage 1210 and tank 1220 can be undesirable. In this respect, it is best to minimize the weight of any device used on a motor vehicle. This necessitates the use of lightweight materials when and where they can be used. One way to reduce weight is by reducing material thicknesses. Thus, thinner materials have been investigated which can drastically reduce the weight of a muffler. However, these thinner materials must still function similar to the thicker materials that they replace or they cannot be used. It was found that the material thickness of outer walls 1230, 1232, 1234 and 1236 could only be reduced so much before they began to vibrate as the sound or fluid pulse entered and exited the sound chamber. This vibration is particularly problematic with the casing or housing of the sound chamber wherein casing resonance resulted from unrestricted fluid flow in and out of the sound chamber. This casing resonance is an unwanted sound that can be as objectionable as sounds produced by the vehicle's exhaust. While internal ribbing or other structural reinforcing members were considered, this adds weight and adds to the cost of the muffler. Thus, it was first believed that the weight reduction would not be as significant as first desired.

It was then found that a perforated or porous sheet or cap added to a connector tube for a Helmholtz resonator could control the amount of sound attenuation for an exhaust muffler and reduce the excitation from engine pressure pulses that can cause the casing resonance. The multi functional purpose of the face sheet enables a designer to reduce the thickness of the case surrounding the muffler, and hence reduce weight and cost. The porosity of the face sheet may vary from 10 to 60 percent open to provide the flow resistivity needed to tune the outer sound chamber to reduce or eliminate this casing resonance. Lower porosity increases the flow resistance and modifies the engine's unsteady pressure pulses entering and exiting the Helmholtz resonator chamber. The porosity controls the amplitude of the pressure pulse that couples with the structural resonant frequencies of the case enclosing the muffler. An optimum porosity can be determined experimentally that provides the desired overall sound pressure levels from the muffler while reducing the casing structural resonance.

Figures 30, 31:
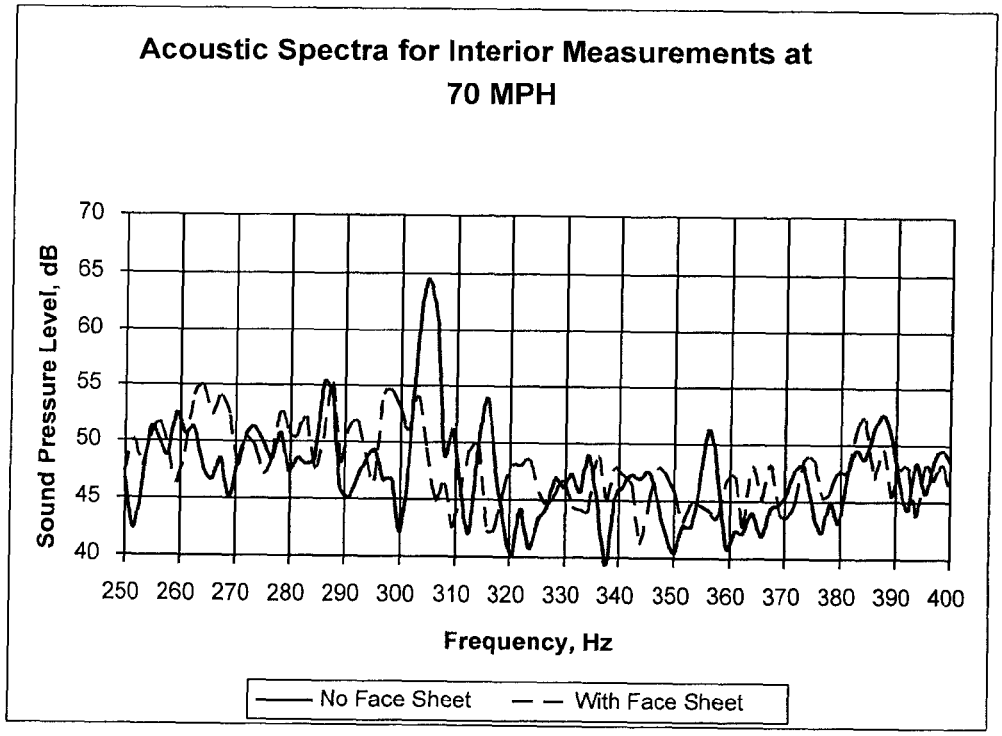
FIG. 30 is a chart relating to another study of a different group of vehicles and other aspects of the invention of this application; and, FIG. 31 is a plot showing an acoustic sound spectra measured inside a vehicle while driving at a constant speed of 70 mph.

With reference to FIG. 31, shown is experimental evidence of this benefit for a muffler that was developed for a 2008 VOLKSWAGEN GTI. The plot shows acoustic sound spectra measured inside the vehicle while driving at a constant speed of 70 mph. The solid line is the acoustic spectra for a muffler without a porous face sheet. There is a strong tone at 305 Hz that was determined to be a structural vibration mode from the casing. A porous face sheet was added at the end of the connector tube with a porosity of 28% open area. The measurements were repeated and the tone was reduced by about 10 dB, as shown by the dotted line in the figure. The case resonance was no longer audible.

With reference to FIGS. 22-24, shown is muffler 1200 having a connector 1240 with a perforate sheet or cap 1266. As with other embodiments of this application, muffler 1200 can have more than one connecter, such as connector 1242 which includes the same cap configuration. More particularly, cap or perforate sheet 1266 is a sheet layer 1270 having perforations or openings 1272 in layer 1270 such that openings 1272 together form an opened area or portion in the plate that is smaller than the cross-sectional area of the connector body which, in this embodiment, is defined by an inner diameter 1276 of connectors 1240 and 1242. As discussed above, this opened area of the member or plate influences flow of the sound or fluid pulse from the exhaust gas entering and exiting the tank or sound chamber. This restriction in flow of the fluid between pipe or passage 1210 and sound chamber 1222 can be used to reduce the severity of the pulses entering the sound chamber and reduce case resonance. This configuration can also improve the attenuation of many exhaust flows. While a sheet layer is shown, other porous configurations could be utilized without detracting from the invention of this application including, but not limited to, screen-like materials.

In one embodiment, these perforations or openings in plate 1270 form an open portion of the plate that is less than 60 percent of the plate area. In another embodiment, the open portion of plate 1270 is less than 50 percent. In yet anther embodiment, the open portion is less than 40 percent. In further embodiments, the open portion is between 10 and 40 percent. In yet further embodiments, the open portion is approximately 30 percent. In one embodiment, the opened area is between 20 percent and 40 percent of the cross-sectional area of the connector body. In another embodiment, the opened area is between 25 percent and 35 percent of the cross-sectional area of the connector body. In a further embodiment, the opened area is between 30 percent and 35 percent of the cross-sectional area of the connector body. In yet a further embodiment, the opened area is approximately 33 percent of the cross-sectional area of the connector body.

In yet other embodiments, the connector body has a cross-sectional area between around 0.20 square inches and around 7.00 square inches. In even yet another embodiment, the cross-sectional area is between around 0.70 square inches and around 5.30 square inches. These different configurations can be used to tune a particular sound frequency out of an exhaust gas flow.

The connector body further includes a connector length 1280 generally extending between first end 1250 and second end 1254 wherein the length of these connectors can also be used to influence the attenuation of the muffler.

With reference to FIGS. 25-28, a wide range of connector and tank combinations are shown in accordance with the invention of this application. These can be used with or without a cap or perforate sheet 1266. However, as discussed above, sheet 1266 can be used to reduce casing resonance which allows the use of thinner materials.

More particularly, it has been found that the connector arrangement of the embodiments of this application allow use of simplistic tank style muffler systems in applications previously considered not suitable for tank muffler systems. While traditional tank style mufflers are in the prior art, these systems are too large and inefficient for use with many vehicles. Further, these large systems are too heavy to meet ever increasing fuel efficiency requirements.

Figure 25:
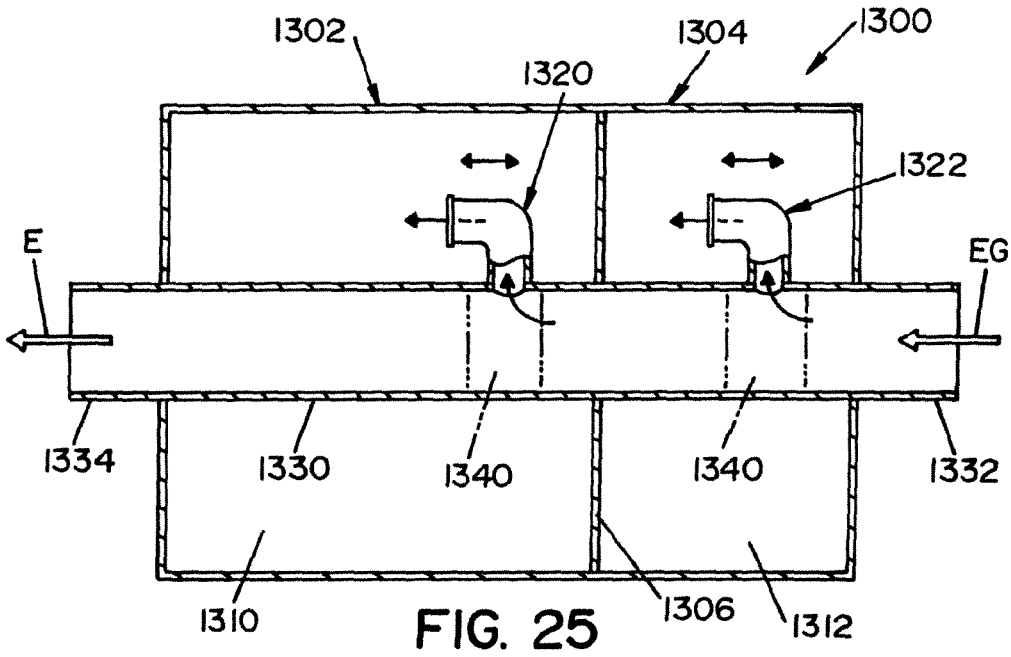
FIG. 25 is a top sectional view of another embodiment of this application that includes multiple connectors and multiple tanks in accordance with an aspect of the invention of this application.

FIG. 25 shows a muffler 1300 that includes single connector arrangements in two tanks In this respect, muffler 1300 includes a first tank 1302 and a second tank 1304 separated by a divider 1306. Further, tank 1302 has a first tank volume 1310 and tank 1304 has a second tank volume 1312 wherein the volumes can be different. In this embodiment, tank volume 1310 is greater than tank volume 1312. Muffler 1300 further includes two single connectors 1320 and 1322 positioned in tanks 1302 and 1304, respectively. These connectors can be any one of the connectors described in this application without detracting from the invention of this application. Connectors 1320 and 1322 are joined to a passage or through pipe 1330 of muffler 1300 which extends between an inlet 1332 and an outlet 1334. As with other embodiments in this application, the connectors are positioned in a connector region 1340 of pipe 1330. While it is preferred that region 1340 be near inlet 1332, this is not required.

Figure 26:
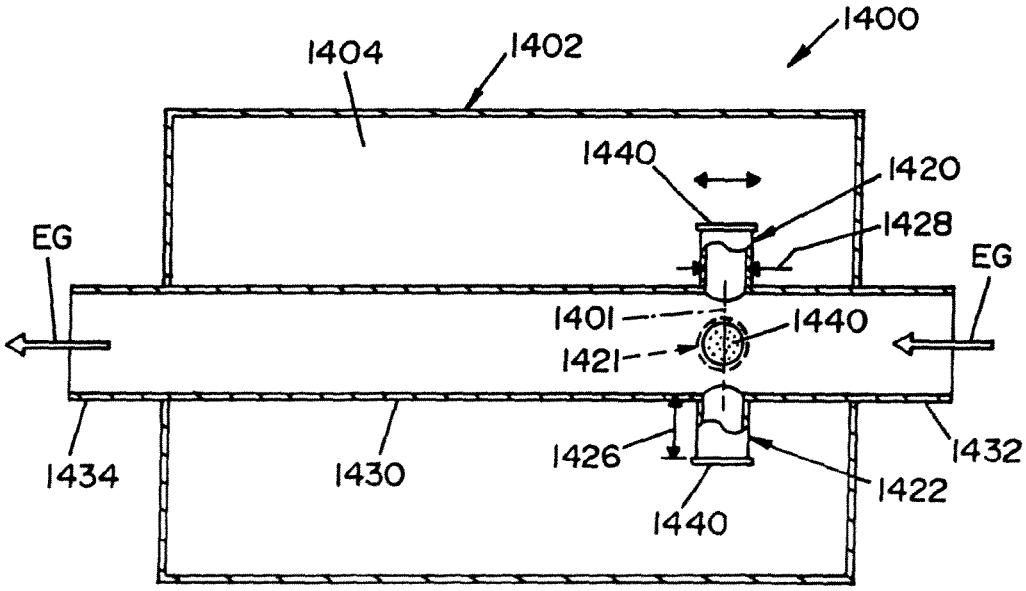
FIG. 26 is a top sectional view of a further embodiment of this application that includes multiple connectors in accordance with an aspect of the invention of this application.

With reference to FIG. 26, shown is a muffler 1400 that includes quad connector arrangements in a single plane 1401 connector region. Further, this embodiment is a single tank arrangement that has no side branch attenuation chamber included. This embodiment also includes connectors 1420-1423 (1423 not shown) extending circumferentially about a passage or pipe 1430 wherein the connectors have a straight connector body configuration with a length 1426 and an inner diameter 1428. The connectors join a tank 1402 of muffler 1400, having a tank volume 1404, a passage or pipe 1430. As with other embodiments of this application, through pipe 1430 extends from an inlet 1432 to an outlet 1434 and which can have multiple inlets and/or outlets without detracting from the invention of this application. As stated above, connectors 1420-1423 are joined to passage 1430 at plane 1401 wherein the connectors allow fluid communication between the pipe and the tank thereby allowing the sound or fluid pulse from exhaust gases EG to enter and exit the tank. While not shown in this embodiment, connectors 1420-1423 could also include porous members including, but not limited to, the porous end plates 1440 discussed above.

Figure 27:
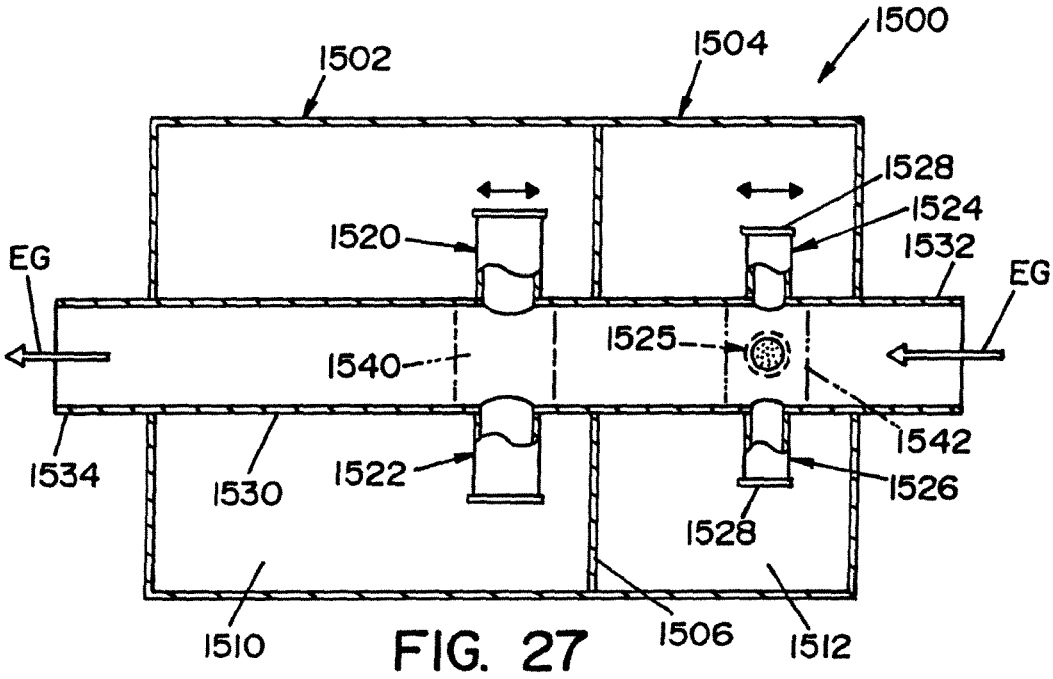
FIG. 27 is a top sectional view of another embodiment of this application that includes multiple connectors and multiple tanks in accordance with an aspect of the invention of this application.

With reference to FIG. 27, shown is a muffler 1500 that includes multiple connector arrangements in two tanks. In this respect, muffler 1500 includes a first tank 1502 and a second tank 1504 separated by a divider 1506. However, it should be noted that dividers described in this application could be any known divider in the industry including, but not limited to, separate end walls for each tank. Further, muffler 1500 does not include a side branch style sound attenuation arrangement. First tank 1502 has a first tank volume 1510 and tank 1504 has a second tank volume 1512 wherein the volumes can be different. In this embodiment, tank volume 1510 is greater than tank volume 1512. Muffler 1500 further includes two multiple connector arrangements including a two connector arrangement in tank 1502 having connectors 1520 and 1522 and a three connector arrangement in tank 1504 having connectors 1524-1526. Connectors 1520 and 1522 are positioned in connector region 1540 and connectors 1524-1526 are positioned in connector region 1542. These connectors can be any one of the connectors described in this application without detracting from the invention of this application.

Muffler 1500 further includes a passage or through pipe 1530 extending from an inlet 1532 to an outlet 1534 wherein connectors 1520, 1522, and 1524-1526 are joined to passage 1530 between the inlet and the outlet in the respective regions. Further, in this embodiment, connectors 1520 and 1522 are a different size than connectors 1524-1526. More particularly, connectors 1520 and 1522 are both longer and have a different diameter or cross-sectional area than connectors 1524-1526. Further, connectors 1524-1526 include porous members 1528.

Figure 28:
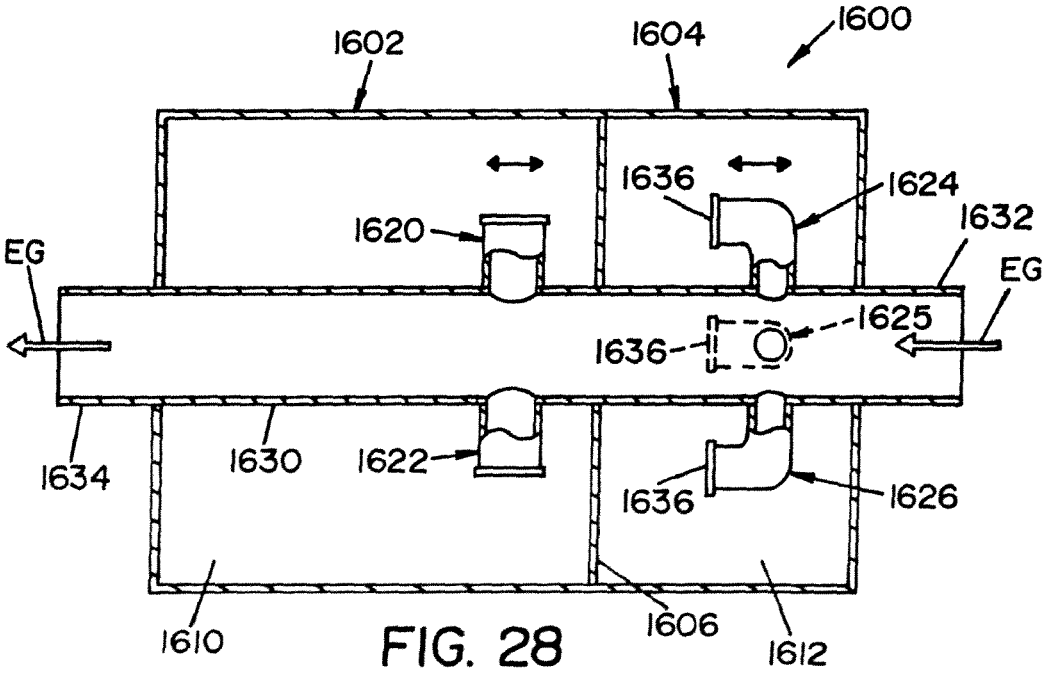
FIG. 28 is a top sectional view of another embodiment of this application that includes multiple connectors and multiple tanks in accordance with an aspect of the invention of this application.

With reference to FIG. 28, shown is a muffler 1600 that also includes multiple connector arrangements in two tanks. In this respect, muffler 1600 includes a first tank 1602 and a second tank 1604 separated by a divider 1606. Tank 1602 has a first tank volume 1610 and tank 1604 has a second tank volume 1612 wherein the volumes can be different. In this embodiment, tank volume 1610 is greater than tank volume 1612. Muffler 1600 further includes two multiple connector arrangements including a two connector arrangement in tank 1602 having connectors 1620 and 1622 and a three connector arrangement in tank 1604 having connectors 1624-1626. These connectors can be any one of the connectors described in this application without detracting from the invention of this application and/or any combination thereof which is described above and below.

Muffler 1600 has a passage or through pipe 1630 extending from an inlet 1632 to an outlet 1634 wherein connectors 1620, 1622, and 1624-1626 are joined to passage 1630 between the inlet and the outlet. As with other embodiments in this application, connectors can be positioned along pipe 1630 in different locations. However, in this embodiment, connectors 1620 and 1622 are both a different size than connectors 1624-1626 and a different configuration. In this respect, connectors 1620 and 1622 are straight connectors and connectors 1624-1626 are angled connectors. Connectors 1620 and 1622 are also a different size than connectors 1624-1626. Yet even further, connectors 1620 and 1622 can have a different porous member than connectors 1624-1627 including, but not limited to, a porous end plates 1636 having a different opened percentage.

Another aspect of the invention which makes significant improvements over prior art tank mufflers is the configuration of the connector. In this respect, in one embodiment, the connector has a connector region with an axial length less than 5 inches. Further, the connector area can be at least 75 percent of the passage area. In other embodiments, the connector area is at least 80 percent of the passage area or connector area is at least 84 percent of the passage area.

In yet another embodiment, the connector is a single cylindrical connector wherein the connector diameter is at least 80 percent of the passage diameter. In other embodiments, the connector diameter is at least 90 percent of the passage diameter.

In even yet other embodiments, the connector region length is less than 3.5 inches or is less than 2.5 inches. In some embodiments, the connector region is a single plane transverse to the through pipe.

In other embodiments, two connectors are utilized wherein each has a connector diameter 30 to 80 percent of the passage diameter. In another embodiment, the connector diameter is between 35 and 70 percent of the passage diameter.

In even yet another embodiment, the tubular sound connector has a length and a cross-sectional area which together defines a sound connector volume and this connector volume is at least 1 cubic inch. In other embodiments, this connector volume is at least 8 cubic inches or even at least 15 cubic inches.

In a further embodiment, this connector volume is between 2 and 5.5 percent of the attenuation or tank volume. In other embodiments, the connector volume is between 3 and 4.75 percent of the attenuation volume.

In yet a further embodiment, the combined length of the connectors times the diameter of the connectors is between 1 and 3 percent of the attenuation volume. In another embodiment, the ratio between the cross-sectional area of the elongated fluid passage and the attenuation volume is between 0.006 and 0.015. In other embodiments, this ratio is between 0.0075 and 0.0125. As is shown above, the combination of connectors and tanks are numerous. Further, as is shown in FIGS. 29 and 30, different vehicles can have different sound requirements wherein the muffler according to the present invention could have a unique configuration for each vehicle to maximize efficiency and performance thereby achieving the best results. The chart in FIG. 30 shows configurations found to work that utilize porous end plates.

The following summary provides a suggested range for the design parameters identified in the table:

Target frequencies: 40 to 1000 Hz
Pipe diameters: 2.5 to 4 inches
Number of connectors: 1 to 4
Connector lengths: up to 4 inches
Connector I.D.: 0.50 to 3.00 inches
Aperture plate porosity: 20 to 35% open area
Tank volume: 200 to 2000 cubic inches The following are variations for the tank design of this application:

Tanks can be used as single or multiple elements in a muffler system. Our experience shows one to four tanks can be combined to provide a wider frequency range of attenuation.

Tanks can be combined with other mufflers such as MFSB or dissipative methods.

Tanks can be combined to add dissipative treatment inside the volume to attenuate higher frequencies while also functioning as a resonator to attenuate lower frequencies.

The location of the connector tubes between the exhaust pipe and the tank is important.

The location of the connector tubes relative to the optimal acoustic impedance locations which can be calculated from the tailpipe exit, engine manifold, catalytic converters, and crossover balance tubes is important.

The shape of the tank can be varied with the available space for the muffler. The dimensions of the tank should be small compared to the wavelength of the target frequencies of sound being attenuated.

In yet another embodiment, the porous plate has an area between 20 percent and 40 percent of the area of the tubular connector. In other embodiments, this area is between 25 percent and 35.

According to yet other embodiments, the improved muffler for reducing the sound caused by gases exhausted from an outlet header of an internal combustion engine can include a pipe defining an elongated fluid passage extending between an exhaust gas inlet connected to the header outlet and an exhaust gas outlet communicated with the environmental atmosphere, a closed sound attenuation chamber surrounding the pipe, the chamber being coextensive with and transverse to the fluid passage, and at least one connector in the fluid passage for fluid communication with the attenuation chamber, wherein:

(a) the closed chamber has a volume V;
(b) the fluid passage has a diameter PD;
(c) the distance between the exhaust inlet and exhaust outlet is PL: and,
(d) the distance between the connector tube and the exhaust outlet is CL;

Wherein at least one connector being tubular and having a length L and the connector length L is less than about 8 inches, the tubular connector extending radially from the fluid passage into the attenuation chamber.

The improvement as discussed above wherein the connector tube has a diameter CD and L times CD times the number of connector tubes, either 1 or 2, divided by volume V is in the range of about 0.001 to 0.043.

The improvement as discussed above wherein CL times PD divided by PL is in the range of about 0.27 to 2.13.

The improvement as discussed above wherein CL times PD divided by PL is in the range of about 0.27 to 2.13.

The improvement as discussed above wherein the elongated fluid passage has a cross-sectional passage area PA and the at least one connector has a cross-sectional connector area CA transverse to PA, CA being at least 75 percent of PA.

The improvement as discussed above wherein CA is at least 80 percent of PA.

The improvement as discussed above wherein CA is at least 84 percent of PA.

The improvement as discussed above wherein the at least one connector is a single tubular connector and has a diameter CD, CD being at least 80 percent of PD.

The improvement as discussed above wherein CD is at least 90 percent of PD.

The improvement as discussed above wherein the at least one connector is two connectors each having a connector diameter CD, CD being between 30 and 80 percent of PD.

The improvement as discussed above wherein CD is between 35 & 75 percent of PD.

The improvement as discussed above wherein the at least one connector has a cross-sectional connector area CA, L times CA substantially defining a connector volume CV, CV being at least 1 cubic inches.

The improvement as discussed above wherein CV is at least 8 cubic inches.

The improvement as discussed above wherein CV is at least 15 cubic inches.

The improvement as discussed above wherein the at least one connector has a cross-sectional connector area CA, L times CA substantially defining a connector volume CV, CV being between 0.08 and 7.8 percent of V.

The improvement as discussed above wherein CV is between 3 and 4.75 percent of V.

The improvement as discussed above wherein the at least one tubular sound connector has a combined length CCL when the length of each the connector is added together, the at least one connector having a connector diameter CD, CCL times CD being between 0.07 and 3 percent of V.

The improvement as discussed above wherein the at least one tubular sound connector has a combined length CCL when the length of each the connector is added together, the at least one connector having a connector diameter CD, CCL times CD being between 1 and 2.7 percent of V.

The improvement as discussed above wherein the elongated fluid passage has a cross-sectional passage area PA, PA divided by V being between 0.004 and 0.018.

The improvement as discussed above wherein PA divided by V is between 0.0075 and 0.0125.

The improvement as discussed above wherein PA divided by V is between 0.006 and 0.015.

The improvement as discussed above wherein the fluid passage has a connector region extending axially between the inlet and outlet, all of the at least one connector tubes extending axial from the connector region, the connector region having an axial length less than 5 inches.

The improvement as discussed above wherein the connector length L is less than about 5 inches.

The improvement as discussed above wherein the tubular connector is cylindrical.

The improvement as discussed above wherein the connector tube has a diameter CD and L times CD times the number of connector tubes, either 1 or 2, divided by volume V is in the range of about 0.01 to 0.03.

According to another embodiment, provided is an attenuation muffler for reducing the sounds of combustion gases exhausted from an internal combustion engine comprising: an elongated fluid passage extending between an inlet and an outlet, the inlet being in fluid communication with the gases exhausted from the engine and the outlet being connectable with the atmosphere the fluid passage having a connector region extending axially between the inlet and outlet, the connector region having an axial length less than 5 inches; at least one tubular sound connector in the connector region which is in fluid communication with a sound attenuation chamber wherein the the fluid communication is restricted to the at least one connector, the attenuation chamber being a tank-style chamber extending about the fluid passage and extending generally between the inlet and the outlet.

The muffler as discussed above wherein the elongated fluid passage has a cross-sectional passage area and the at least one connector has a cross-sectional connector area transverse to the cross-sectional area of the fluid passage, the connector area being at least 75 percent of the passage area.

The muffler as discussed above wherein the at least one connector is a single cylindrical connector having a connector diameter and the elongate fluid passage has a passage diameter, the connector diameter being at least 80 percent of the passage diameter.

The muffler as discussed above wherein the connector region length is less than 3.5 inches.

The muffler as discussed above wherein the connector region length is less than 2.5 inches.

The muffler as discussed above wherein the at least one connector is two connectors each having a connector diameter and the elongate fluid passage has a passage diameter, the connector diameter being between 30 and 80 percent of the passage diameter.

The muffler as discussed above wherein the at least one tubular sound connector has a length and a cross-sectional area which together define a sound connector volume, the volume being at least 1 cubic inch.

The muffler as discussed above wherein the at least one tubular sound connector has a length and a cross-sectional area which together define a sound connector volume, the attenuation chamber having an attenuation volume wherein the connector volume is between 0.08 and 7.9 percent of the attenuation volume.

The muffler as discussed above wherein the at least one tubular sound connector has a length and a cross-sectional area which together define a sound connector volume, the attenuation chamber having an attenuation volume wherein the connector volume is between 2 and 5.5 percent of the attenuation volume.

The muffler as discussed above wherein the muffler has an overall length and the connector region is a first connector region and the sound attenuation chamber is a first sound attenuation chamber, the muffler further including a second connector region spaced from the first connector region and the second connector region including at least one sound opening in fluid communication with a second sound attenuation chamber, the second chamber having a sound attenuation passage with a passage length greater than the overall length of the muffler, the passage further including a sound reflection wall spaced from the at least one opening defining the passage length.

The muffler as discussed above wherein the second chamber has a plurality of sound attenuation passages each having a different passage length.

The muffler as discussed above wherein each the at least one tubular sound connector includes a porous plate.

The muffler as discussed above wherein the porous plate has an area between 20 percent and 40 percent of an area of the at least one tubular sound connector.

The muffler as discussed above wherein the porous plate has an area between 25 percent and 35 percent of an area of the at least one tubular sound connector.

The muffler as discussed above wherein the at least one tubular sound connector is four tubular sound connectors.

The muffler as discussed above wherein each the at least one tubular sound connector is cylindrical.

The muffler as discussed above wherein each the at least one tubular sound connector is cylindrical.

The muffler as discussed above wherein the elongated fluid passage extends about a passage axis and the axis defines a central plane dividing the passage into a first side region and a second side region on either side of the plane and circumferentially spaced from one another; the muffler further including a sound attenuation opening in the first region and spaced from the connector region, the attenuation opening for transmitting an associated pressure wave from an associated flow of exhaust gasses into a side attenuation sound chamber, the sound chamber having a flow path with a set length based on the frequency of the associated sound or fluid pulse, the side attenuation chamber being within the tank-style chamber but substantially isolated from the tank-style chamber.

While considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. These combinations include, but are not limited to, combining a tank with an inner vessel arrangement. Accordingly, it is to be distinctly understood that the foregoing descriptive matter is to be interpreted merely as illustrative of the invention and not as a limitation.

Having thus described the invention, it is so claimed:

1. An engine exhaust muffler for reducing sounds from pressure waves of combustion gases from an exhaust flow traveling through an exhaust pipe of a vehicle wherein the flow is caused by gases exhausted from one or more exhaust valves of an internal combustion engine in sound or fluid pulses relating to the flow from these one or more valves, said muffler comprising an elongated fluid passage extending between a muffler inlet and a muffler outlet and said muffler inlet and muffler outlet being connectable with an associated exhaust pipe of the vehicle whereby the elongated fluid passage forms a portion of the associated exhaust pipe and has a cross-sectional area similar to adjacent portions of the associated exhaust pipe such that the exhaust flow travels through said elongated fluid passage without restriction, said muffler further including a closed sound chamber surrounding said passage formed by a side wall extending about said fluid passage and extending between two end plates, said muffler further including at least one tubular connector in said fluid passage between said end plates for fluid communication between said passage and said closed sound chamber, said at least one connector having a tubular body with a first end joined to an opening in said passage and a second end opening into said closed sound chamber, said at least one tubular connector having a perforated resistance plate to restrict the fluid flow between said passage and said sound chamber thereby reducing the severity of the fluid pulses entering said sound chamber, perforations in said perforated plate forming an open portion of said plate and said open portion being less than 60 percent thereby allowing said side wall to be made from thinner material and the weight of said muffler to be reduced.

2. The muffler as defined in claim 1, wherein said open portion of said plate is less than 50 percent.

3. The muffler as defined in claim 1, wherein said open portion of said plate is less than 40 percent.

4. The muffler as defined in claim 3, wherein said open portion of said plate is greater than 10 percent.

5. The muffler as defined in claim 3, wherein said open portion of said plate is greater than 20 percent.

6. The muffler as defined in claim 1, wherein said open portion of said plate is approximately 30 percent.

7. The muffler as defined in claim 1, wherein said side wall is a single sheet of material wrapped about said fluid passage.

8. The muffler as defined in claim 1, wherein said side wall is joined to said passage only by said end plates.

9. The muffler as defined in claim 1, wherein said perforated plate is a perforated end cap at or near said second end.

10. The muffler as defined in claim 1, wherein said at least one connector has a length between said first and second ends, said length being less than about 8 inches, said tubular connector extending radially from said fluid passage into said sound chamber.

11. The muffler as defined in claim 1, wherein said elongated fluid passage has a cross-sectional passage area and said at least one connector has a cross-sectional connector area transverse to said passage area, said connector area being at least 75 percent of said passage area.

12. The muffler as defined in claim 8, wherein said connector area is at least 80 percent of said passage area.

13. The muffler as defined in claim 1, wherein said fluid passage has a connector region extending axially between said muffler inlet and said muffler outlet and having an axial length less than 5 inches, all of said at least one tubular connectors extending radially from said connector region, said region being positioned such that said location is within said connector region.

14. The muffler as defined in claim 13, wherein said connector region has an axial length less than 3 inches.

15. The muffler as defined in claim 1, wherein said closed sound chamber is a first closed sound chamber and said at least one tubular connector is a first at least one tubular connector, said muffler further including a second closed sound chamber and a second at least one connector, said second at least one connector being axially spaced from said first at least one connector, said second closed sound chamber being separated by said first sound chamber by a central plate between said end plates, said side wall forming a portion of said first and second sound chambers.

16. The muffler as defined in claim 1, further including mounting hardware to secure said muffler to an associated vehicle in a mounted condition such that in said mounted condition said muffler has a top, a bottom and opposing sides, said muffler inlet being connectable such that said passage extends about a passage axis and said axis defining a generally vertical central plane when in said mounted condition dividing said passage into a first side region and a second side region on either side of said central plane and circumferentially spaced from one another; said first side region having a first radial extent defined as a portion of said passage in said first side region spaced furthest from said central plane, said second side region having a second radial extent defined as a portion of said passage in said second side region spaced furthest from said central plane, said first and second radial extents generally being opposite to one another and generally being horizontally spaced from one another when in said mounted condition, said elongated fluid passage further including a sound attenuation opening axially spaced from said at least one connector for receiving and transmitting at least one sound or fluid pulse into a side attenuation sound chamber, said side sound chamber extending horizontally from said central plane when in said mounted condition and having a flow path with a set length based on an objectionable frequency of and objectionable wave such that when said pulse exits said sound chamber, it reduces the objectionable amplitude of a subsequent objectionable wave, said sound attenuation chamber having a length less than said muffler length, said side attenuation sound chamber being within said side wall.

17. The muffler as defined in claim 16, wherein said side wall and said end plates form an outer housing of said muffler.

18. The muffler according to claim 16, wherein said elongated fluid passage has a cross-sectional area and said flow path has a cross-sectional area, said flow path cross-sectional area being at least 70% of said passage area.

* * * * *